US006889177B1

(12) United States Patent
Runnels

(10) Patent No.: US 6,889,177 B1
(45) Date of Patent: May 3, 2005

(54) LARGE AREA PATTERN EROSION SIMULATOR

(75) Inventor: Scott R. Runnels, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 590 days.

(21) Appl. No.: 09/695,673

(22) Filed: Oct. 24, 2000

Related U.S. Application Data

(63) Continuation-in-part of application No. 09/124,339, filed on Jul. 29, 1998, now Pat. No. 6,169,931.

(51) Int. Cl.[7] ..... G06F 17/10
(52) U.S. Cl. ..... 703/2; 438/692; 257/E21.23
(58) Field of Search ..... 703/2; 700/97, 700/121; 438/692; 216/88; 257/E21.304, E21.23; 451/5, 9

(56) References Cited

U.S. PATENT DOCUMENTS

| | | | | |
|---|---|---|---|---|
| 4,833,617 A | | 5/1989 | Wang | 364/474.15 |
| 5,367,465 A | | 11/1994 | Tazawa et al. | 364/468 |
| 5,471,403 A | | 11/1995 | Fujimaga | 364/488 |
| 5,514,245 A | | 5/1996 | Doan et al. | 156/636.1 |
| 5,526,293 A | | 6/1996 | Mozumder et al. | 364/578 |
| 5,599,423 A | | 2/1997 | Parker et al. | 156/636.1 |
| 5,637,031 A | | 6/1997 | Chen | 541/41 |
| 5,655,110 A | | 8/1997 | Krivokapic et al. | 395/500 |
| 5,665,202 A | | 9/1997 | Subramanian et al. | 438/692 |
| 5,759,918 A | * | 6/1998 | Hoshizaki et al. | 438/692 |
| 5,786,260 A | * | 7/1998 | Jang et al. | 438/401 |
| 5,851,136 A | * | 12/1998 | Lee | 451/9 |
| 5,865,665 A | * | 2/1999 | Yueh | 451/5 |
| 6,230,069 B1 | * | 5/2001 | Campbell et al. | 700/121 |

OTHER PUBLICATIONS

M. Bhusan et al. "Chemical–Mechanical Polishing in Semi-direct Contact Mode", J. Electrochem. Soc., vol. 142, No. 11, pp. 3845–3851, Nov. 1995.

R. Jairath et al., "Role of Consumables in the Chemical Mechanical Polishing (CMP) of Silicon Oxide Films", SEMATECH Paper.

P. Rentein et al., "Characterization of Mechanical Planarization Processes", VMIC Conference, pp. 57–63, Jun. 1990.

J. Warnock, "A Two Dimensional Process Model for Chemi-mechanical Polish Planarization", J. Electrochem. Soc., vol. 138, No. 8, pp. 2398–2402 Aug. 1991.

S. Sivaram et al., "Measurement and Modeling of Pattern Sensitivity During Chemical Mechanical Polishing of Inter-leval Dielectrics", SEMATECH Paper, Conference Proceedings ULSI–VII, Materials Research Society, pp. 511–517, 1992.

(Continued)

*Primary Examiner*—Albert W. Paladini
(74) *Attorney, Agent, or Firm*—Baker Botts L.L.P.

(57) ABSTRACT

A pseudo-physical model simulates the erosion of large area three-dimensional patterns on workpieces during a chemical mechanical polishing process. The model is based on determining the vertical location of individual nodes on the polishing pad stack and corresponding individual nodes on the workpiece. Contact forces between the pad and the workpiece are determined by the deflection of the pad stack which is transformed into a contact force by modeling the polishing stack as abstract mathematical springs.

31 Claims, 8 Drawing Sheets

OTHER PUBLICATIONS

S. Runnels, "Advances in Physically Based Erosion Simulators for CMP", J. of Electronic Materials, vol. 25, No. 10, pp. 1574–1580, 1996.

M. Ruttan et al., "Pattern Density Effects in Tungsten CMP", Semiconductor International, pp. 123–129, Sep. 1995.

R. Jairath et al., "Consumables for the Chemical Mechanical Polishing (CMP) of Dielectrics and Conductors", Mat. Res. Soc., Invited Paper, Spring 1994.

R. Sivaram et al., "Chemical Mechanical Polishing of Interleval Dielectrics: Models for Removal Rate and Planarity", Mat. Res. Soc. Smp. Proc. vol. 260, pp. 53–64, 1992.

M. Desai et al., "Chemical Mechanical Polishing for Planarization in Manufacturing Evironment", Mat. Res. Soc. Symp. Proc. vol. 337, pp. 99–104, 1994.

A. Hu et al., "Concurrent Deployment of Run by Run Controller Using SCC Framework", IEEE/SEMI Int'l Semiconductor Manufacturing Science Symp. pp. 126–132, 1993.

B. Stine et al., A Closed–From Analytic Model for ILD Thickness Variation in CMP Processes, CMP–MIC Conference, pp. 266–272, 1997.

V.H. Bulsara et al., "Mechanics of Polishing", Transactions of the ASME, vol. 65, pp. 410–416, Jun. 1998.

O.G. Chekina et al., "Wear–Contact Problems and Modeling of Chemical Mechanical Polishing", J. Electrochem. Soc., Vol 145, No. 6, pp. 2100–2106., Jun. 1998.

H. Kim et al., "The Effect of the Pattern Sensitivity on Interlayer Dielectric Planarization", CMP–MIC Conference, pp. 103–109, 1998.

W.–T. Tseng et al., "Distribution of Pressure and Its Effects on the Removal Rate During Chemical–Mechanical Polishing Process", CMP–MIC Conference, pp. 87–94, 1998.

J. Grillaert et al., "Modeling Step Height reduction and Local Removal Rates Based in Pad–Substrate Interactions", CMP–MIC Conference, pp. 79–86, 1998.

* cited by examiner

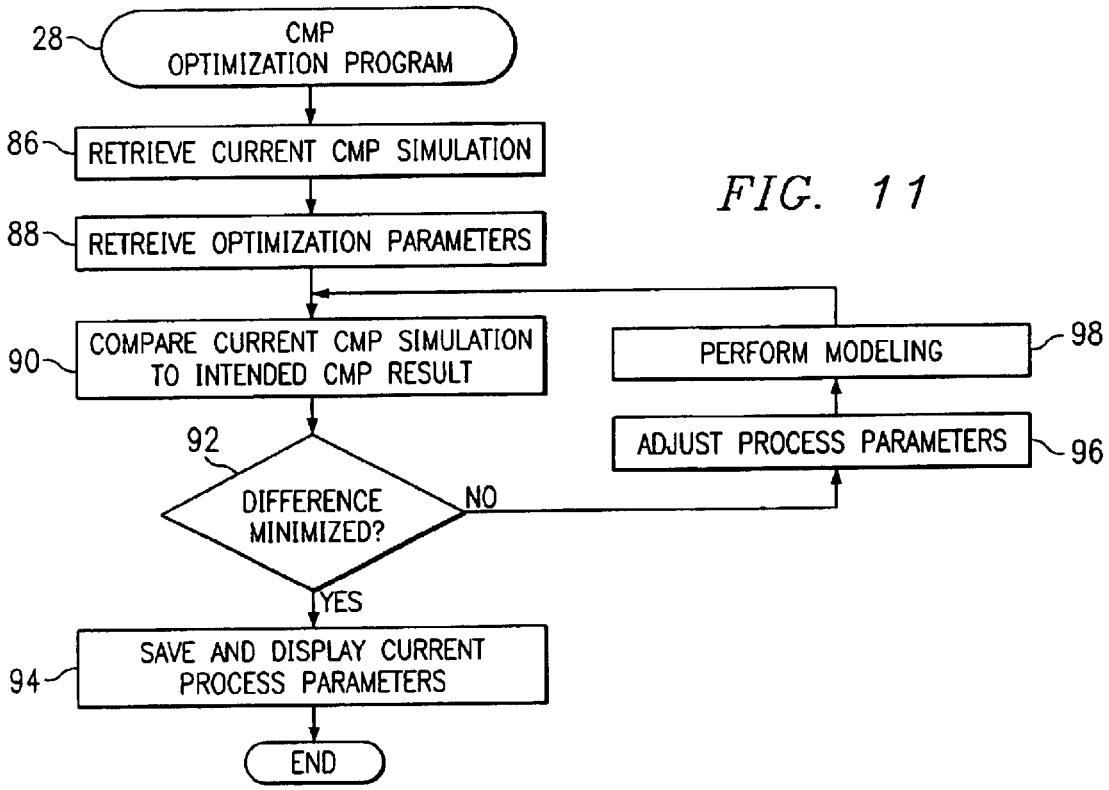
FIG. 11
FIG. 12A
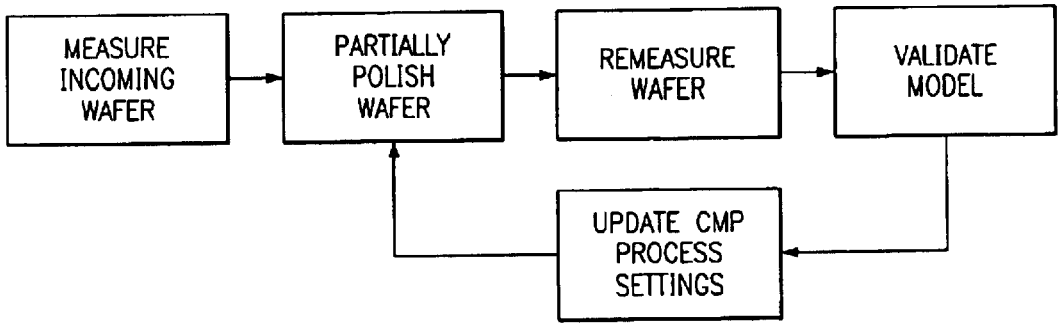

LARGE AREA PATTERN EROSION SIMULATOR

RELATED APPLICATIONS

This application is a continuation-in-part application of 09/124,339, filed Jul. 29, 1998, now U.S. Pat. No. 6,169,931 issued Jan. 2, 2001, entitled "Method and System for Modeling, Predicting and Optimizing Chemical Mechanical Polishing Pad Wear and Extending Pad Life".

TECHNICAL FIELD OF THE INVENTION

The present invention relates generally to systems for the chemical mechanical polishing (CMP) of workpieces such as semiconductor wafers. More particularly, the present invention relates to a pseudo-physical model of both the contact forces between the polishing pad and the wafer and the erosion of the wafer during the polishing process. Specifically, the pseudo-physical model of the present invention simulates the result of a CMP process predict eroding topography and thereby facilitate the optimization of the process parameters associated with the operation of an actual CMP system.

BACKGROUND OF THE INVENTION

Chemical mechanical polishing (CMP) of semiconductor wafers has become the preferred method for planarizing dielectric or metallic layers at various stages of integrated circuit fabrication. During the CMP process, a workpiece surface, such as the surface of a semiconductor wafer, is held against a rotating platen. The rotating platen is covered with one or more-slurry-soaked polishing pads. The combination of the chemical interaction of the slurry with the semiconductor wafer and the friction between the polishing pads and the surface of the semiconductor wafer removes material from the wafer. Because of the small dimensions of silicon wafers and the precise surface finishes required and the costs associated with changing polishing pads, there is a need to gain a better understanding of the CMP process by mathematically predicting the results of a chemical mechanical polishing process.

Although the bulk material removal rate of interlevel dielectric materials by a CMP system is heavily chemistry dependent, there is no chemical preference between the high and low areas on the surface of the wafer being polished. Therefore, when using a CMP process on dielectric materials, the planarization of the polished surface of the wafer is due solely to the mechanical action of the polishing pad against the surface of the wafer. And it is this mechanical action which is predictable by the use of pseudo-physical modeling techniques.

CMP systems are often used to process the silicon dioxide dielectric material (commonly referred to as "oxide") layers from semiconductor wafers. The objective of the use of such CMP systems is to uniformly remove the dielectric material or oxide across the semiconductor wafer being polished such that the small (sub-micron to millimeter) features or surface irregularities that populate the wafer surface are worn away and thereby eliminated. It is important, at the same time, to assure that the overall global characteristics of the wafer surface are maintained. Consequently, the most effective CMP systems provide both wafer scale uniformity (i.e., uniform material removal over the surface of the workpiece) in addition to providing feature scale planarity (i.e., removal of small features or surface irregularities).

In a typical prior art CMP system, as shown in FIG. 1, a polishing pad stack includes a relatively soft base pad and a relatively stiff upper pad (e.g., a polyurethane pad). The upper pad actually contacts the surface of the wafer. The combination of the soft base pad with the relatively stiff upper pad results in a pad stack which is flexible enough to provide uniform material removal or wafer scale uniformity across the surface of a workpiece, yet stiff enough to smooth out the smallest surface irregularities to obtain feature scale planarity. The slurry used for most CMP systems is typically a water based composition which includes suspended colloidal silica particles.

As may be understood by reference to FIGS. 2A and B, CMP is used to planarize the interlevel dielectric material portions of a semiconductor wafer. Typically, the surface of the interlevel dielectric materials on an unpolished semiconductor wafer has a pattern on its surfaces that results from the dielectric material being deposited over a pattern of metal lines. The imbedded metal lines within the dielectric material will form the electrical connections on the surface of the wafer after the dielectric material has been removed by CMP.

As shown in FIGS. 3A and B, a CMP system may alternatively be used to polish away deposited metal films such as tungsten or copper by completely removing them from a dielectric substrate—except for that portion of the deposited layer of tungsten or copper which remains in the trenches which are pre-etched into the underlying dielectric material.

The mechanical aspect of the CMP process in the removal of small surface irregularities or feature scale is the underlying reason why the density of the pattern formed by the imbedded metal lines (FIG. 2) on the surface of the wafer plays a big role in the effectiveness of a CMP process on removing interlevel dielectric materials from the surface of a wafer. In other CMP processes, which are designed to remove surface metal instead of interlevel dielectric materials, the initial planarization of the deposited metal film reflects the topography of the underlying dielectric material. The removal of metal by a CMP system is more dependent on chemistry than on the density of pattern lines. The removal of a deposited metal film by CMP has a chemical preference that results in a natural "polish stop," wherein the barrier between the resulting main conductor and the dielectric material is relatively resistant to the slurry on the polishing pads. (The slurry is typically custom blended for the type of metal to be removed.) Since polishing is never absolutely perfectly uniform across a wafer surface, the deposited metal remaining in the trenches etched in the dielectric material, from which the conductors are formed, may be "dished out" at the top of the trenches while the last of the barrier layer of deposited metal film is being removed from the surface of the wafer (FIG. 3). Therefore, for this additional reason, the underlying pattern density of the dielectric material plays a significant role in the operation of a CMP process to remove a deposited metal film.

The quality of a finished workpiece subjected to a CMP process may be expressed in terms of both workpiece surface uniformity and workpiece surface planarity. Consequently, the particular CMP process parameters selected, to include: pad rigidity, slurry composition, polish time, relative speed of the wafer and the polishing pad, down force imparted on the wafer carrier, the dynamics of the workpiece carrier motion, etc., assure that the polished workpiece exhibits a desired surface uniformity and surface planarity. For example, the selection of a CMP process parameter such as the use of a comparatively rigid upper pad will tend to planarize the surface of a workpiece better than a comparatively resilient upper pad. Similarly, the selection of a relatively resilient upper pad will provide better global uniformity because it can conform to the overall shape and contour of the workpiece surface.

Many prior art systems developed to mathematically model a CMP process have focused on calculating the CMP system parameters needed to optimize the global uniformity of the finished workpiece without considering the negative effect that such optimization may have on the feature scale planarity of the finished workpiece. The results obtained from such prior art CMP modeling systems fail to effectively strike an optimized balance between both predicting workpiece surface uniformity and workpiece surface planarity.

In the use of CMP processes on interlevel dielectric materials, the term "local planarity", which is a feature scale measurement, can be used to designate when small surface thickness variations on the surface of the interlevel dielectric material are within a desired tolerance (FIGS. 2A and 2B). The analogous measurement in the use of a CMP process to remove a deposited metal film is the amount of dishing of the deposited metal in the top of the trenches in the dielectric material (FIGS. 3A and 3B). In both types of CMP processes, the need to achieve local planarity requires that material be selectively removed on the feature scale. However, selectivity on the feature scale competes, in turn, with the need for uniform removal of material on the wafer scale. A successful CMP process is one that operates effectively in a CMP process regime to ultimately optimize both the feature scale and the wafer scale measurements on the surface of a polished workpiece.

It is appropriate to mention that other mathematical models directed specifically to feature scale erosion and planarization have been developed. One of the first published feature scale erosion and planarization models appears in the article, "A Two-Dimensional Process Model for Chemical Polish Planarization" by J. Warnock which was published in the August 1991 issue of the *Journal of the Electrochemical Society*. An extensive review of Dr. Warnock's model reveals that its parameters were heavily dependent on the surface pattern of the wafer, thereby restricting the applicability of Dr. Warnock's model as a predictive tool to a narrow range of applications.

Recently, a closed-form mathematical model describing the relationship between pattern density and the rate of removal of material during the polishing process was published by Stine, et al. in an article entitled "A Closed-Form Analytic Model for ILD Thickness Variation in CMP Processes" which appeared in the February 1997 *CMP-MIC Conference Journal*. The Stine, et al. model modifies the pressure distribution used in the Preston equation for material removal rate based on the local pattern density (The Preston equation indicates that the material removal rate during a polishing process is directly proportional to both the force between the wafer and the polishing pad, and the relative speed of the wafer and the polishing pad.).

A feature scale mathematical model based solely on pad compression was recently presented by Grillaert, et al. entitled "Modeling Step Height Reduction and Local Removal Rates Based on Pad-Substrate Interactions" at the February 1998 CMP-MIC Conference. The Grillaert, et al. model represents a superset of the closed-form analytic model disclosed in the Stine, et al. article. While effective for some applications, the Grillaert, et al. model still falls short of achieving accurate prediction of CMP results because it does not account for the flexural bending of the polishing pads. The flexural bending of polishing pads always occurs during an actual polishing process.

The prior art CMP process model disclosed in U.S. Pat. No. 5,599,423, issued to Parker et al., is designed to simulate and ultimately optimize a semiconductor wafer polishing process. The Parker et al. model is based upon experimental techniques to optimize the polishing parameters. In particular, the Parker et al. model iteratively varies the process polishing parameters, measures the actual polishing results associated with each process iteration, and then analyzes the empirical data to suggest an optimized polishing process. However, the Parker et al. model simply optimizes the global uniformity of the wafer surface without regard to the effect that such global optimization of wafer scale uniformity will have on the feature scale planarity of the polished wafer. Due to its inherent limitations, the Parker et al. model is not capable of optimizing the CMP process parameters in accordance with an initial feature scale pattern or in accordance with an intended planarization characteristic of the polished wafer.

Other prior art CMP process modeling or simulation techniques lack the capability to calculate a sufficient number of modeling parameters such that simulation errors can be minimized. Such prior art CMP process modeling or simulation techniques may produce inaccurate simulation results that do not take advantage of the historical empirical data associated with a particular set of CMP process parameters. Furthermore, prior art CMP modeling systems are often limited to use with a particular CMP system configuration. Such CMP modeling systems are limited by not being capable of processing empirical and/or simulated processing results associated with one CMP system configuration to model or design another theoretical CMP system configuration which has a number of different physical characteristics and a number of different process parameters.

Finding and expanding a successful mathematical mode for a CMP process is a critical need for those involved in the engineering of manufacturing processes utilizing CMP. In the past, expensive experimental techniques have been the primary method to define a successful CMP process. Therefore, the ability to reliably model and thereby predict feature scale surface thickness variations or wafer scale material removal without having to rely on expensive actual experimentation techniques is highly desirable. Such a reliable and predictive model could be used to define one or more variables in a CMP process regime. For example, it is well known that a high down-force will generally improve the global uniformity of the wafer scale of the polished surface by providing a more uniform contact between the wafer and the polishing pad, but high down forces on the wafer carrier also decrease the rate of local planarization of feature scale because the polishing pad is forced into more intimate contact with low areas on the surface being polished. Similarly, the use of a comparatively resilient polishing pad stack will produce better uniformity characteristics but poorer planarization capability.

In addition there is a need for a mathematical model for a CMP process which enables the prediction of pad life as proper timing of the need for changing polishing pads minimizes the cost of a CMP process.

Accordingly, a robust, predictive model for a CMP process is needed that can be used to determine, among other CMP process parameters, the optimal wafer carrier down force and the best pad rigidity to produce the desired surface uniformity and planarity on a workpiece for a given CMP process regime.

SUMMARY OF THE INVENTION

The pseudo-physical predictive model for a chemical mechanical polishing (CMP) process regime of the present invention may be used to predict both the wafer scale measurement and the feature scale measurement resulting after the completion of a CMP process. More particularly, the disclosed pseudo-physical CMP model may also be used for determining, among other CMP process parameters, the optimal wafer carrier down force and the proper pad rigidity for obtaining the desired amount of surface uniformity and planarization.

The pseudo-physical CMP model disclosed herein is based on the premise that the amount of erosion of a wafer surface by polishing is proportional to the local contact force between the polishing pad and the wafer being polished. The constant of proportionality is termed the "erosion rate coefficient", E, which describes the blanket material removal rate as a function of the local contact force (e.g., microns/second of removal per pound of force). The erosion rate coefficient E accounts for not only the chemical aspects of a CMP process, but also the average amount of wafer to pad contact and the relative velocities imposed by the particular CMP process regime under study.

The disclosed pseudo-physical mathematical CMP model for a CMP process is capable of providing predictions of both wafer scale uniformity and feature scale planarity on the surface of a finished workpiece.

Further, the disclosed pseudo-physical CMP process model can generate an optimized set of CMP process parameters that are based on a specified balance between wafer scale uniformity and feature scale planarity.

The present invention also provides a pseudo-physical CMP process model that calculates its modeling parameters in accordance with empirically determined CMP results to thereby minimize errors in the CMP simulation process.

The present invention provides a pseudo-physical CMP process model that employs interpolation techniques which enable the effective simulation of CMP process results where little or no empirical data exists.

Finally, the disclosed pseudo-physical CMP process model enables the use of simulation data which is collected for an existing CMP system. The collected simulation data aids in the design of a new CMP system configuration that has different physical and process characteristics than an existing CMP system configuration.

BRIEF DESCRIPTION OF THE DRAWINGS

A more complete understanding of the method for pseudo-physical modeling of a CMP process, of the present invention, may be had by referring to the detailed description and claims when considered in connection with the drawing FIGUREs, wherein:

FIG. 11 is a flow diagram of the CMP process parameter optimization process;

FIG. 12A is a flow diagram of a simplified CMP process model calculation;

DETAILED DESCRIPTION OF THE INVENTION

General-Model Applicability

Figure 1:
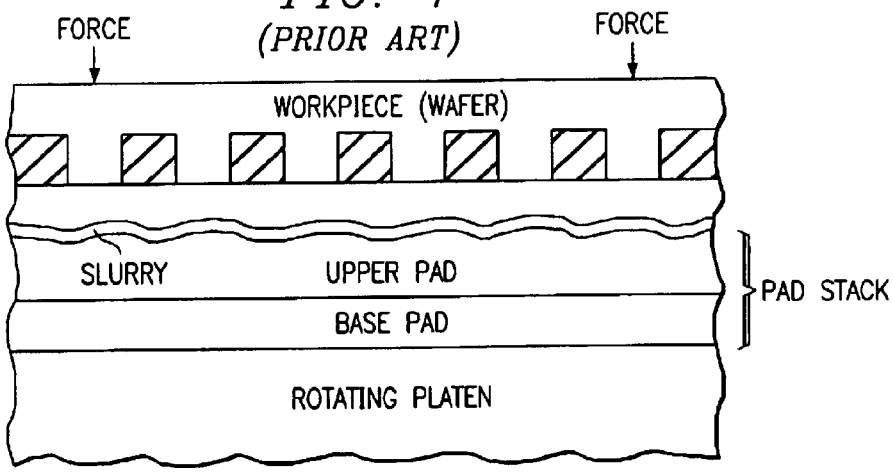
FIG. 1 (PRIOR ART)
FIG. 1 is a cross-sectional view of the standard prior art configuration of a chemical mechanical polishing process for the creation of a mathematical model.
Figure 2A:
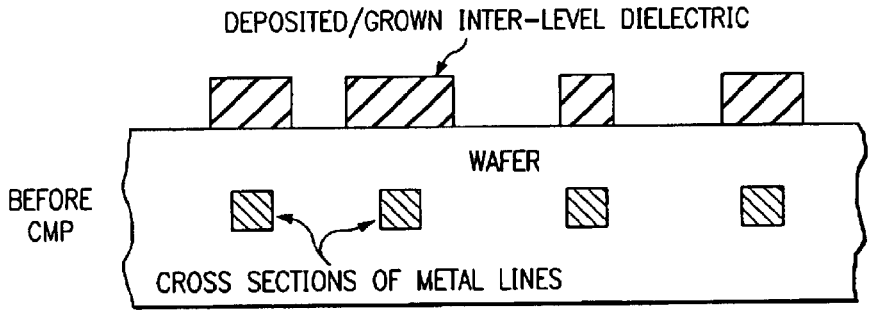
FIG. 2A (PRIOR ART)
FIG. 2A is a cross sectional view of the surface of a wafer before CMP having deposited or grown interlevel dielectric material which is to be removed by CMP.
Figure 2B:
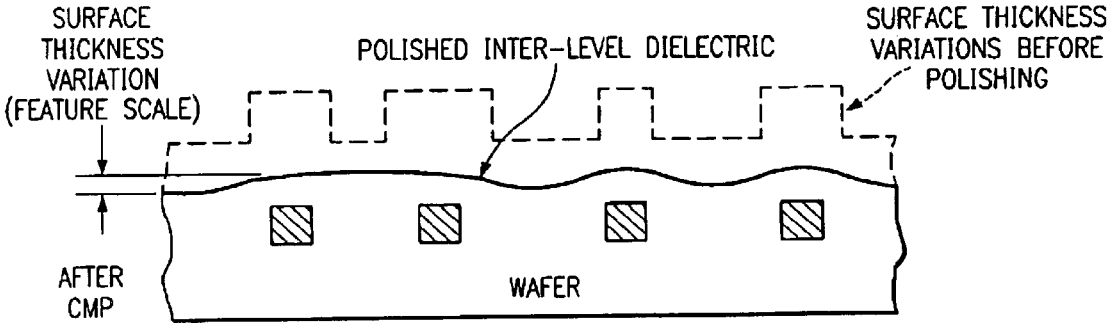
FIG. 2B (PRIOR ART)
FIG. 2B is a cross sectional view of the surface of a wafer after CMP wherein the interlevel dielectric has been removed by CMP.
Figure 3A:
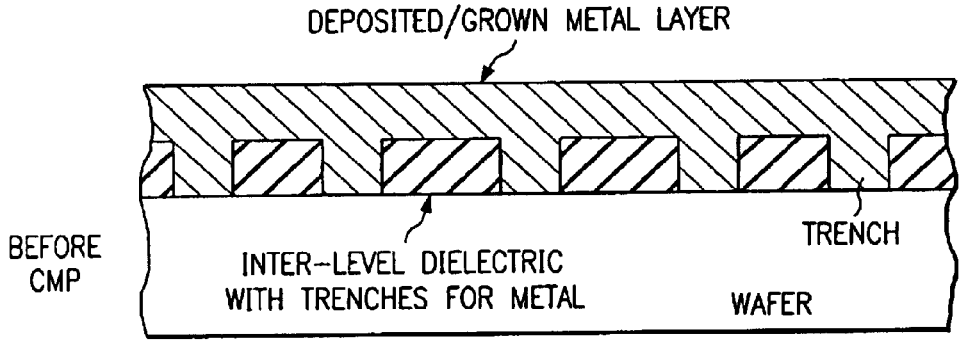
FIG. 3A (PRIOR ART)
FIG. 3A is a cross sectional view of the surface of a wafer before CMP having a deposited or grown metal film layer which is to be removed by CMP.
Figure 3B:
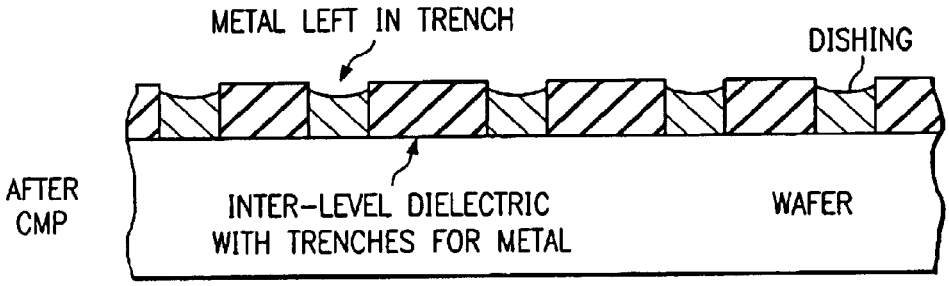
FIG. 3B (PRIOR ART)
FIG. 3B is a cross sectional view of the surface of a wafer after CMP wherein the deposited metal film layer has been removed by CMP.

The pseudo-physical chemical mechanical polishing (CMP) process model of a preferred embodiment of the present invention may be used in conjunction with any suitable CMP system configuration designed for the actual removal of material from the surface of a workpiece. Although the pseudo-physical CMP process model 10 (FIG. 6) and an actual CMP system 12 may be utilized in the context of any number of different types of workpieces, the pseudo-physical CMP process model is described herein in the context of its use for polishing semiconductor wafers. It will also be appreciated by those of ordinary skill in the art that the present invention is not limited to any particular CMP system configuration or to any specific type of workpieces. Furthermore, because the use of a CMP process is generally well known in the semiconductor fabrication industry, the details of semiconductor fabrication will not be described in detail herein except where necessary for an understanding of the present invention.

Material Removal Simulation

Although the present invention may incorporate any number of suitable modeling techniques, the preferred embodiment utilizes methodologies based on the Preston equation for material removal during a polishing process:

Material Removal Rate (R)=kPS, where k (Preston coefficient) is a factor representing chemical effects, P is the pressure or force imparted by the wafer onto the polishing pad, and S is the relative speed between a point on the surface of the wafer and a point on the polishing pad. In other words, the product PS represents the mechanical effects associated with the CMP process. Although the Preston equation is relatively simple, the value of the Preston coefficient k has a significant amount of inherent uncertainty because the chemical effects, represented by the Preston coefficient k, include the chemical reactions between the polishing slurry and the surface of the wafer in addition to the availability of the polishing slurry at the surface of the wafer. Consequently, the value of the Preston coefficient k can be affected by the chemical composition of the polishing slurry, the chemical composition of the wafer, the rigidity characteristics of the polishing pad, the wafer carrier speed, and the speed of the polishing table. Indeed, although the Preston coefficient k may be held constant to simplify the CMP process simulation routine, the value of the Preston coefficient k may actually vary across the surface of the wafer.

The force P imparted by the wafer on the polishing pad may also vary across the surface of the wafer being polished. The force P is typically better defined than the Preston coefficient k. For example, the average value for the pressure or force P can be computed by simply dividing the wafer carrier down force by the surface area of the wafer. Additional factors such as the curvature of the wafer backing film and the positions of vacuum holes (employed by the wafer carrier to secure the wafer) may be analyzed to effectively estimate how the force P is distributed across the surface of the wafer. For the exemplary CMP process application described herein, the force P varies quadratically with the radius of the wafer.

The computation of the relative speeds between a point on the surface of the wafer and a point on the polishing pad is accomplished through a straightforward application of kinematics. Accordingly, the value of the relative speed S between the surface of the wafer and the polishing pad can be predicted with near certainty. Because the relative speed S does not affect the Preston coefficient k or the force P, the effect of the relative speed S on the CMP process can be predicted with a high degree of confidence.

In the preferred embodiment, the Preston coefficient k is one of the pre-determined modeling parameters. Changing the Preston coefficient k results in a corresponding scaling of the material removal rate associated with the simulated CMP process. In addition to the Preston coefficient k, the pseudo-physical modeling system 10 of the present invention preferably employs additional modeling parameters to specify the pressure or force distribution across the surface of the wafer. As described above, the actual average pressure or force across the surface of the wafer can be easily calculated if the wafer carrier down force and the surface area of the wafer are known. Thus, the pseudo-physical CMP modeling system 10 uses the additional modeling parameters (up to five in the preferred embodiment) to approximate the actual pressure distribution across the surface of the wafer and to simulate the corresponding material removal characteristics associated with the CMP procedure. It should be noted that the pseudo-physical CMP modeling system 10 may be configured to hold the Preston coefficient k equal to zero when the current interrogation or sampling point is located over a groove or gap in the simulated polishing element or when the simulated wafer is overhanging the edge of the simulation polishing element. This additional consideration may be desirable to compensate for those sampling points where the polishing pad does not or cannot contact the surface of the wafer.

Computer Requirements

Figure 6:
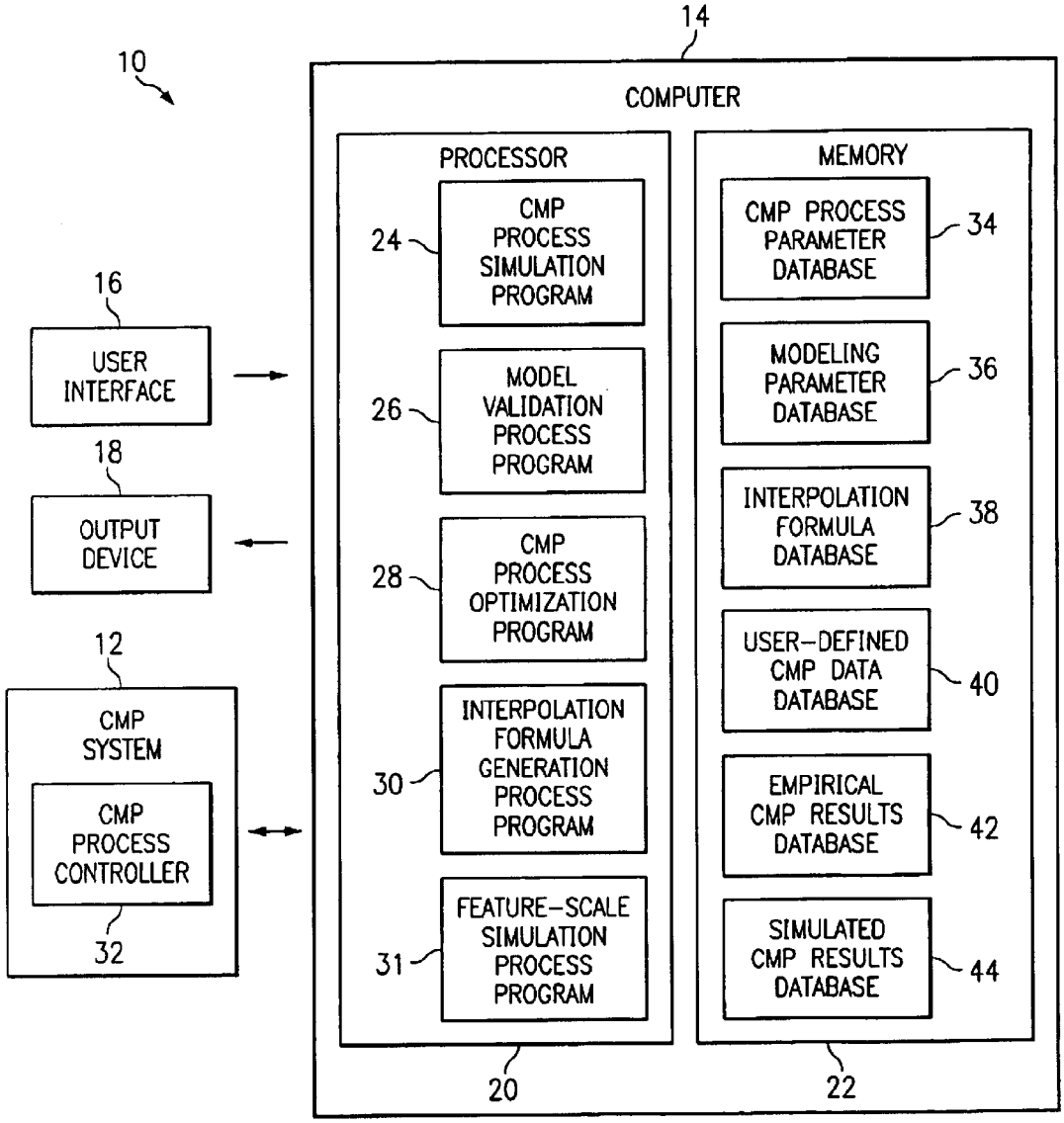
FIG. 6 is a schematic diagram of an exemplary computer system on which the pseudo-physical CMP process model of the present invention may be implemented.

As shown in FIG. 6, the effective use of the pseudo-physical modeling system 10 is enabled by the use of a computer 14, supported by a user interface 16, and an output device 18. In the preferred embodiment, the computer 14 is configured similar to a conventional personal computer including suitable processing capability 20 and memory capacity 22.

The user interface 16 is configured to enable an operator to input data into the pseudo-physical CMP modeling system 10 as needed, manipulate the modeling results, and otherwise control the operation of the CMP process model 10. The output device 18 may be a conventional computer display terminal, a printer, a plotter, or any component suitable for displaying the modeling results and the other information produced by the pseudo-physical CMP process model 10.

Alternatively, the computer 14 may be part of a mainframe computing system, part of a computer network environment, or made an integral part of an actual CMP configuration system configuration 12. Indeed, the computer 14 portion of the system may take a variety of different forms as long as it includes a sufficient amount of processing capability and memory capacity to support the calculations needed to support the CMP process model disclosed below.

Processor 20 is preferably configured to carry out a number of processes (described below) employed in the pseudo-physical CMP process model 10. The capability to carryout such processes may be obtained from software programs stored within memory 22 or within a separate memory element associated with computer 14. For the sake of convenience, FIG. 6 depicts a CMP simulation process program 24, a model validation process program 28, a CMP optimization process program 28, an interpolation formula generation process program 30, and a feature scale simulation process program 31 as discrete functional blocks resident within the computer processor 20. The processor 20 (and/or computer 14) is preferably configured to interact with a user interface 16, an output device 18, and an actual CMP system 12 (via, e.g., a CMP controller 32).

The computer memory 22 cooperates with the processor 20 in a conventional manner, to store, update, and provide CMP process modeling, CMP process history data, and user-defined data to and from the processor 20. Although the computer memory 22 may be arranged in any suitable manner, FIG. 6 depicts a computer memory 22 organized into a number of distinct databases for the sake of clarity. In particular, the pseudo-physical CMP process model 10 preferably includes at least one CMP process parameter database 34, a modeling parameter database 36, an interpolation formula database 38, a user-defined CMP data database 40, an empirical CMP process history database 42, and a simulated CMP results database 44. It should be appreciated that the above databases 34, 36, 38, 40, 42, and 44 need not be located in a single memory element and that one or more of the databases may be stored on a removable storage medium such as a floppy disk or a CD-ROM.

Interface with the Actual CNIP Process

The actual CMP system configuration in use 12 may communicate with the pseudo-physical CMP process model 10 in a manner that facilitates the real-time optimization of the CMP process parameters, termed the "CMP recipe", as the surface of a wafer is being polished. To accomplish this, the pseudo-physical CMP process model 10 may provide adjustment instructions to the CMP process controller 32 as necessary during the actual running of a CMP process. Feedback of empirical measurement data may be provided to the pseudo-physical CMP process model 10 via the CMP controller 32, which may obtain measurement data from any number of in-situ workpiece measurement systems. Systems for the measurement of semiconductor layer thickness, feature scale planarity, and global wafer scale uniformity are well known to those skilled in the art and will not be described in detail herein.

System Operation

The pseudo-physical CMP process model 10 generally operates to simulate a CMP process on both a wafer scale (for, e.g., uniformity estimates) and a micro-feature scale (for, e.g., planarity estimates). The pseudo-physical CMP modeling system 10 is capable of optimizing the CMP process parameters, e.g., the CMP recipe, in accordance with a user-defined initial surface feature pattern on the wafer, a user-defined local feature profile, and/or a user-defined weighting of the relative importance of feature scale planarity to wafer scale uniformity.

Figure 7:
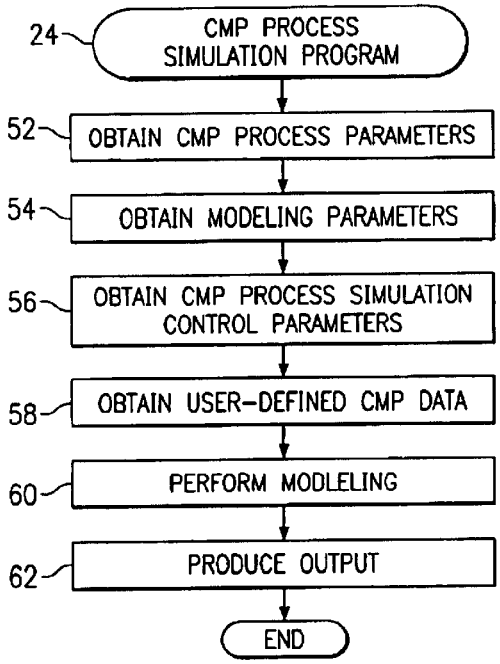
FIG. 7 is a flow diagram of the process for simulating CMP.

The pseudo-physical CMP process model 10 may be configured to utilize one or more default initial modeling parameters for simulating a given CMP process simulation (FIG. 7). The user has the option to alter such default initial modeling parameters as desired. Similarly, the pseudo-physical CMP process model 10 of the present invention may provide a number of default coefficients for a given modeling parameter to simplify the amount of custom data entry required during step 54. As described in more detail below, step 54 may simply be used to input a set of pre-determined initial modeling parameters that have been optimized for a particular CMP system configuration, a particular wafer size, and/or the chemical composition of a particular wafer.

Referring now to FIG. 7, the CMP simulation process program 24 employed by the pseudo-physical CMP modeling system 10 is depicted as a flow diagram. The CMP simulation process program 24 is carried out by the computer 14. Several user-defined CMP process parameters, required to run the CMP simulation process program 24, are obtained by input to the computer 14 through user interface 16. In the preferred embodiment, an operator is prompted to input the specific data needed to run the simulation program 24. In response to such prompts, the user manually inputs the requested data, selects values generated by the pseudo-physical CMP modeling system 10, or accepts one or more default values.

CMIP Process Parameters

As shown in FIG. 7, the CMP simulation process 24 preferably includes an initial process parameter step 52, during which step 52 the pseudo-physical modeling system 10 obtains a plurality of CMP process parameters associated with a CMP procedure to be performed upon a workpiece. A "CMP process parameter" is any quantity, characteristic, dimension, or other variable that may have an effect upon the outcome of an actual CMP process. For example, such CMP process parameters may be related to the desired CMP recipe, e.g., polish time, speed of the polishing element and associated acceleration ramp time, workpiece carrier speed and acceleration ramp time, workpiece carrier down force acceleration ramp time, workpiece carrier sweep range, and workpiece carrier sweep speed. A different CMP recipe may also be specified for distinct polishing stages of the CMP process. In addition to polishing recipe information, the CMP process parameters may relate to the physical characteristics of the particular CMP system 12 utilized during the CMP process, e.g., dimensions and/or rigidity of the polishing pad, dimensions of the workpiece to be polished, characteristics of the carrier sweep range and pivot point, and the like. It should be noted that any number of CMP process parameters may be put into the model during step 52 and that the pseudo-physical CMP process model 10 may provide one or more default CMP process parameters or facilitate the selection of one or more preexisting CMP system configurations during step 52. The selected CMP process parameters may be stored in a database 34 (see FIG. 7) for future use.

Initial Modeling Parameters

The CMP simulation process program 24 shown in FIG. 7 also involves a second step 54, during which step a plurality of initial modeling parameters are put into the pseudo-physical CMP process model 10. Once obtained, the modeling parameters maybe stored in a data-base 36 and then subsequently accessed by the pseudo-physical CMP process model 10. These modeling parameters are utilized by the CMP process model 10 to compute a simulated CMP result associated with, inter alia, the CMP process parameters. As explained above, each CMP modeling parameter is expressed in terms of a quadratic equation. These quadratic equations include a number of user-definable coefficients. Thus, step 54 may obtain or calculate the initial CMP process modeling parameters after a number of user-defined coefficients have been received. In the context of the present invention, each of the initial CMP modeling parameters may be a function of one or more of the CMP process parameters, including: the polishing table speed, the workpiece carrier speed, the workpiece carrier down force, the polishing element composition or construction, the slurry characteristics, and the characteristics of the particular film layers being processed, each of which is associated with the particular CMP procedure to be simulated.

Simulation Control Parameters

Referring again to FIG. 7, the CMP simulation process program 24 may also perform a third step 56, during which step 56 a number of pre-determined CMP process simulation control parameters are put into the pseudo-physical CMP process model 10. The pre-determined simulation control parameters are related to the manner in which the CMP process simulation is carried out. For example, the pseudo-physical CMP modeling system 10 is preferably configured such that a simulated CMP result includes the data associated with a plurality of discrete sampling points on the surface of a given workpiece. The use of discrete sampling points on the surface of a given workpiece enables the precise comparison of the simulated CMP process results to empirical CMP process results measured at the same points. Accordingly, the pre-determined simulation control parameters may be related to the actual location and the actual number of sampling points on the surface of the wafer, the coordinate system used for an output plot, and the time periods associated with repeated simulations for common sampling points. Of course, any number of additional settings or variables related to the CMP process simulation control parameters may be put in during the execution of step 56.

User Defined Data

By further reference to FIG. 7, a fourth step 58 is preferably performed to input special user-defined CMP data associated with the actual CMP process to be analyzed. The data obtained during step 58 is preferably stored in a database 40 (see FIG. 7) for use by the pseudo-physical CMP process model 10. For purposes of the present invention, "user-defined CMP data" includes theoretical, desired, or actual characteristics of the original or the processed wafer that may have an effect on the execution of the CMP process simulation 24. For example, the suggested CMP recipe generated by the pseudo-physical CMP process model 10 may be dependent upon an initial feature scale pattern on the surface of the workpiece, an initial local film thickness profile on the surface of the workpiece, a desired level of global wafer scale uniformity on the surface of the workpiece, or a desired level of feature scale planarization. In addition, the CMP simulation procedure conducted by the pseudo-physical CMP process model 10 may be dependent upon an indicator of the relative importance of wafer scale uniformity to feature scale planarization for the surface of the finished workpiece.

During the execution of step 58, data indicative of an initial pattern on the surface of the wafer and/or an initial film thickness profile may be put in any suitable format. For example, a given pattern may be formed from a plurality of arrays, each array being defined by a plurality of nodes. Each array may then be defined by the number of features contained therein, the length of its head section, the length of its tail section, the number of "hills" and the height of the hills, the length of the spaces or "valleys" between the hills, and other descriptive elements. In practice, the user may input the physical characteristics of the pattern features on the surface of the workpiece, numerical descriptors, or a graphical rendering of the pattern to convey the initial pattern on the surface to be polished to the pseudo-physical CMP process model 10. Similarly, the initial thickness profile may be rendered in any suitable manner, e.g., on a point-by-point basis.

The performance indicator of the relative importance of wafer scale uniformity to feature scale planarity may be expressed as a ratio, a percentage, a scaled number, a graphical representation, or in any suitable manner. For instance, an evenly weighted indicator may cause the pseudo-physical CMP process model 10 to optimize both wafer scale uniformity and feature scale planarity and to generate a set of CMP process parameters or a particular CMP recipe to reflect the proper balance between wafer scale uniformity and feature scale planarity. However, a performance indicator that favors wafer scale uniformity may cause the pseudo-physical CMP process model 10 to produce an entirely different CMP recipe that is intended to increase the global uniformity of the surface of the wafer at the expense of feature scale planarization on the surface of the wafer.

Flexibility of Data Input

It should be noted that inputs associated with all of the above steps 52, 54, 56, and 58 of FIG. 7 need not be used during the running of the CMP simulation process program 24. Additionally, the inputs associated with steps 52, 54, 56, and 58 may be made in a different order than that described herein. In addition, the relevant data need not be organized, arranged, or obtained in the specific manner described above. For example, the CMP recipe (CMP process parameters), the initial surface pattern (user defined pattern), and the indicator of global wafer scale uniformity versus feature scale planarization (user defined data) may all be lumped together as CMP user-defined data. Likewise, the initial CMP process modeling parameters and the CMP process simulation control parameters may all be lumped together as either initial modeling parameters or simulation control parameters. In addition, the data and information set forth above may be received by the computer 14, the memory 22, or the processor 20 (or other components of computer 14) in any suitable manner and such data and information may eventually be stored in the memory 22 or routed to the processor 20 for further manipulation in accordance with the various processes carried out by the computer 14 when executing the pseudo-physical CMP process model 10.

Production of Simulated CMP Result

After the appropriate input data has been received by the pseudo-physical CMP modeling system 10, the execution of a step 60 in FIG. 7 causes the pseudo-physical CMP process model 10 to perform an appropriate modeling routine to obtain a simulated CMP process result for the given workpiece. The simulated CMP process result is eventually stored in a database 44 (see FIG. 6). This data may then be used during subsequent runs of the pseudo-physical modeling system 10. In the preferred embodiment, the simulated CMP process result is associated with the CMP process parameters, the initial modeling parameters, and at least one element of the user-defined CMP data. In other words, the simulated CMP result generated by the pseudo-physical CMP process model 10 is sensitive to a change in any of the user-defined CMP data.

Exemplary Governing Equation

As described above, the Preston equation relates the film thickness at a number of discrete sampling points to a number of variables associated with the CMP modeling procedure. For example, let ($x_i$ $y_i$) be the coordinates of N sampling points on the surface of the wafer (where i=1,2,3, . . . , N), and let Ti, be the film thickness at the particular sampling point. Then, the instantaneous film thickness for each sampling point on the surface of wafer is governed by the following differential equation, which is based on the Preston equation:

$$\frac{dT_1}{dt} = -k(t)P(x_i, y_i, t)\|V_p(x_i, y_i, t) - V_w(x_i y_i, t)\|;$$

where:

i=1,2,3, . . . N;

k(t)=the Preston Coefficient;

p=Pressure at the sampling point ($x_i$, $y_i$, t):

$V_p$=Velocity of the polishing pad under the sampling point ($x_i$, $y_i$, t); and $V_w$, =Velocity of the wafer at the sampling point ($x_i$, $y_i$, t).

Erosion Force Relationship

Figure 4:
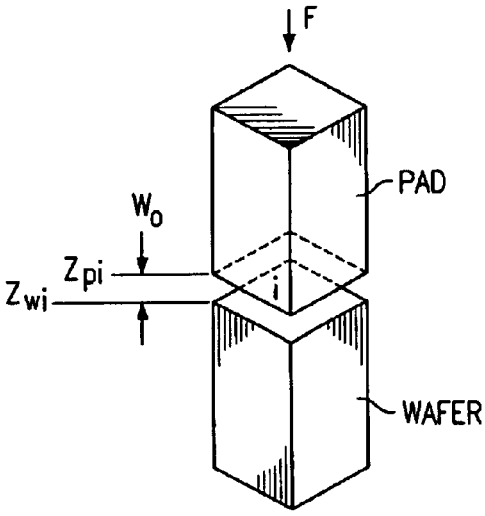
FIG. 4 is a perspective view of a wafer node and a pad node about which the mathematical model of the present invention is based, which illustrates their interaction and the forces therebetween.

In practice, the pseudo-physical CMP modeling system 10 of the present invention performs a number of numerical computations to solve the foregoing differential equation which is based primarily on the Preston equation. As previously indicated, the relative speed of the wafer to the pad, expressed as $\|V_p(x_i,y_i,t)-V_w(x_i,y_i,t)\|$ in the foregoing equation, can be predicted with near certainty. Therefore, the purpose of the pseudo-physical CMP process model 10 is to determine P, the pressure at the sampling point. Once P is determined, the solution to the foregoing differential equation is related to the theoretical material removal rate associated with the specified CMP procedure. The theoretical force distribution derived from the various modeling parameters used to simulate the CMP process is applied during the running of the simulation model to predict the film thickness at the specific sampling point or points on the surface of the wafer. The change or decrease in film thickness indicates how much material has been removed. It should also be appreciated that the rate of material removal from the surface of the wafer or the change in film thickness per unit of time, which is dependent upon the amount of force applied by the polishing pad on the surface of the wafer, may differ from wafer to wafer and within each wafer. As shown in FIG. 4, the pseudo-physical CMP process model 10 preferably analyzes the amount of force applied to the wafer on a localized nodal scale and determines the erosion of a particular wafer node in response to the localized force at a particular wafer node.

Figure 5:
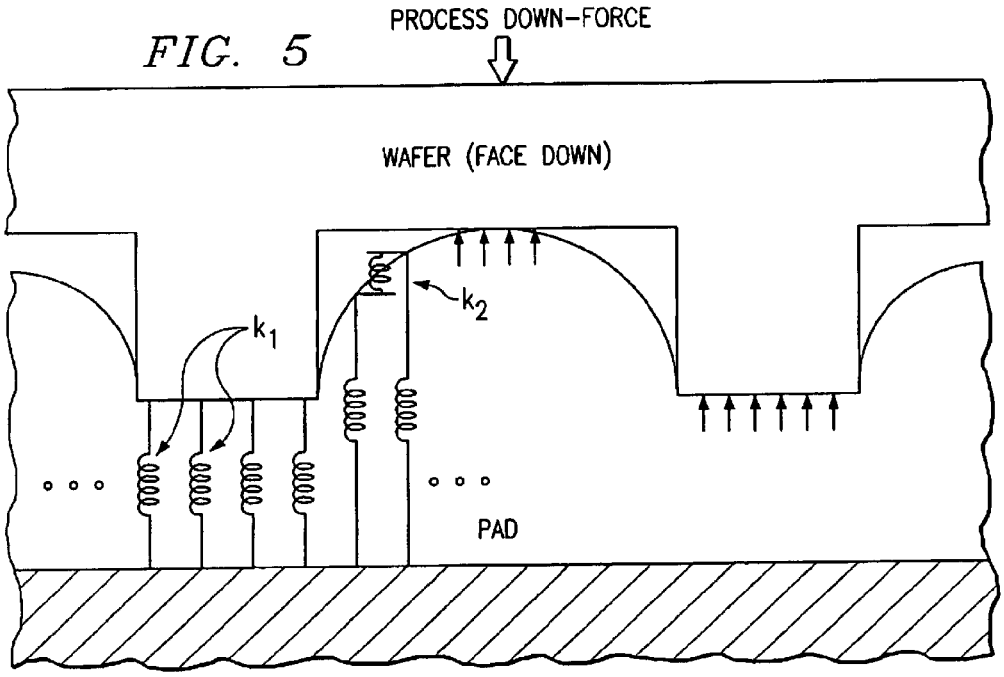
FIG. 5 is a schematic diagram depicting the spring forces used to mathematically model the elastic deformation of the pad stack.

The nodal contact forces between the polishing pad and the wafer to be polished are determined by simulating the elastic deformation of the pad stack by first and second abstract mathematical springs, as shown in FIG. 5. The polishing base pad is modeled as a group of springs, each having compressibility $k_1$. The top polishing pad is modeled as a group of auxiliary springs connected in series to the base pad springs, each having a compressibility $k_2$. The top spring model is mathematically tied to the base pad spring model. As shown in FIG. 4, by simultaneously requiring that vertical forces be balanced at each point or node on the polishing pad and the corresponding point or node on the wafer to be polished, the shape of the pad, the areas of contact, and the local contact force P can be computed. Because the properties of the pad and the down-force on the surface of the wafer are incorporated directly into the model, the effect of changing these physical aspects of the CMP process can be directly evaluated for any particular CMP situation.

Description of the Pseudo-Physical CMP Process Model Algorithm

A better understanding of the operation of the pseudo-physical CMP process model 10 of the present invention for determining the forces P at a pad node begins by an understanding of the terminology and naming the conventions used. Specifically, W represents a geometric plane surface that is, on average, parallel to the front-side of the wafer (the side to be polished), and $C_w$ is a Cartesian coordinate system described with respect to plane W by a set of 3 points ($x_w$, $y_w$, $z_w$) which are established on plane w, such that $x_w$=0 corresponds to a point actually on plane W. The wafer surface is modeled by dividing it into a collection of points called "nodes" in the three-dimensional space defined in $C_w$. In the preferred embodiment, both quad-tree meshing and bi-tree meshing techniques are used.

Each wafer node is numbered, and the individual locations of each wafer node are denoted by a subscript. For example, the location of the wafer node i is ($w_{wi}$, $y_{wi}$, $z_{wi}$). Associated with each wafer node is a dimension $dx_i$, and $dy_i$ in the $x_w$ and $y_w$ directions respectively. The dimension $dx_i$, and $dy_i$ define a rectangle surrounding the node's projection into the $z_w$=0 plane (i.e., the point ($w_{wi}$, $y_{wi}$, 0)). The defined rectangle on the wafer surface is referred to as a "cell" and is given the same number as the wafer node it contains. Those cells on the wafer surface adjacent to cell i are defined to be those that share at least part of one of their cell boundaries with that of cell i. The erosion of the features on the wafer surface during the polishing process is represented by the change in location of the $z_w$ coordinate of a nodal point on the wafer cell during the CMP process simulation. The integer array mi(j), j=1,2,3, . . . , $M_i$ contains a list of the $M_i$ cells that are adjacent to that of cell i.

P represents a geometric plane surface that is, on average, parallel to the surface of the pad. $C_p$ is a Cartesian coordinate system whose z-axis is co-linear with, but in the opposite direction of $C_w$'s z-axis. The coordinates in $C_p$ are ($x_i$, $y_{wi}$, $z_p$) where when $z_p$=0, $z_p$ corresponds to a point on plane P. The pad surface is modeled using a collection of points called "pad nodes" in the three-dimensional space defined by $C_p$. In a manner identical to the numbering system for the wafer nodes, the pad nodes are numbered and their locations are denoted by a subscript. The x-y position of each node on the pad surface is the same as the x-y position of the counterpart node on the wafer surface. For example, the location of a pad node i is ($x_i$, $y_{wi}$, $z_{pi}$). Associated with each pad node is the same spacing in the $x_w$ and $y_w$ directions as used for the wafer node. Thereby each pad cell is defined in a manner that is exactly the same as the definition for each wafer cell. The deformation of the pad's surface caused by the force on the workpiece is represented by the change in location of the vertical position of the pad nodes during the CMP process simulation.

As shown in FIG. 4, planes W and P are further constrained to be parallel to one another and separated from one another by a distance denoted by $w_o$ such that when the vertical position of a node on the pad, $z_p$=$w_o$, the point on the pad is on the geometric plane W. Note that a location of a wafer node relative to coordinate system $C_p$ is therefore ($x_{wi}$, $y_{wi}$, $w_o$−$z_{wi}$).

The following conditions are hereby defined by the foregoing system to describe both wafer nodes and pad nodes:

1.) Wafer Nodes and Pad Nodes Not In Contact: If $w_o-z_{wi}>z_{pi}$, then the wafer nodes and the pad nodes are not in contact at node i.

2.) Wafer Nodes and Pad Nodes In Contact: If $w_o-z_{wi}=z_{pi}$, then the wafer nodes and the pad nodes are in contact at node i. C denotes the set of wafer and pad nodes which are in contact.

During a simulation of a CMP process, the x-y location of both the pads nodes and the wafer nodes do not change. But the vertical locations of both the pad nodes $z_{pi}$, and the wafer nodes and $z_{wi}$, do change. The changes in the vertical position $z_{wi}$ of the wafer nodes represent the actual erosion of the wafer during the CMP process while the changes in the vertical location $z_{pi}$ of the pad nodes represent the deflection of the pad's surface that occurs when the surface of a wafer is pressed against the pad during the polishing process. The amount of the deflection of the pad and the erosion of the wafer is determined based on the mathematical modeling of the forces which are exchanged between each pair of wafer and pad nodes at their point of contact.

For each node i in the pad, the pseudo-physical nature of the disclosed model assumes that a first abstract mathematical spring-like device is connected at the pad node i at the point ($x_i$, $y_i$, 0). When the vertical location of a pad node i $z_{pi}$=$p_o$, which is defined as the pad's natural position, the first abstract mathematical spring-like device is set to exert no force on the pad node i. When the vertical position of a pad node $z_{pi}$ is less than $p_o$, the first abstract mathematical spring representing the rigidity of the base pad is referred to as being "compressed." The first abstract mathematical spring therefore exerts a force, in the positive $z_p$ direction, in an amount that is directly related to the amount of its compression, $p_o$,−$z_{pi}$, and the size of the cell, which is designated by the length of its sides $dx_i$, $dy_i$. When the vertical position of the pad node $z_{pi}$ is less than $P_o$, the first abstract mathematical spring representing the rigidity of the base pad is referred to as being "stretched" and therefore the spring exerts a force in the negative $z_p$ direction in an amount that is directly related to the amount of its stretching, $z_{pi}-z_{po}$. The force in the positive z direction exerted on the pad node is a first function of the spring deflection and the dimensions of the pad node $F_{li}\equiv F_l$, ($p_o-z_{pi}$, $d_x$, $d_{yi}$). For clarity, a simple linear model of the abstract mathematical spring force of the base pad can be adopted wherein:

$$F_{1i}=-rk_i(p_o-z_{pi})dx_idy_i$$

and $F_{1i}$ is the spring force at node i;

$rk_1$ is a Hookean spring constant of the base pad;

$p_o-z_{pi}$ is the amount of compression of the first abstract mathematical spring;

$dx_i$, $dy_i$ is the area of an individual cell.

For each adjacent pair of nodes, i and j on the top pad, there is a second abstract mathematical spring-like device, representing the rigidity of the top pad, connected between the vertical locations $z_{pi}$ and $z_{pj}$ of the adjacent pad nodes i and j. When the vertical position of adjacent pad nodes is the same or when $z_{pi}=z_{pj}$, which is defined as "no bending", the second abstract mathematical spring exerts no force on either of the two adjacent nodes. But when the vertical position of adjacent pad nodes is not equal, or $z_{pi}\neq z_{pj}$, then the second abstract mathematical spring-like device, representing the rigidity of the top pad, exerts a force in the z direction on both adjacent nodes. This force is of a magnitude that is a function of: i) the difference between the vertical position of adjacent spring nodes $z_{pi}$ and $z_{pj}$, ii) the length of $l_{ij}$ of the line segment common to cells i and j, and iii) a parameter h, which represents (but needs not be numerical equal to) the thickness of the top polishing pad. The force in the positive z direction exerted by the second abstract mathematical spring on the pad node i is a second function of the difference in the vertical position of adjacent spring nodes, the length of a common line segment, and the thickness of the top polishing pad. Therefore it may be denoted by one function $F_{2[i][j]}=F_2(z_{pi}-z_{pj},l,h)$. The spring force $F_{2[i][j]}$ on the top pad attributable to adjacent pad nodes is then defined by the equation:

$$F_{2[i][j]}=rk_2(z_{pj}-z_{pi})l_{ij}h$$

wherein $rk_2$ is a Hookean spring constant;

$z_{pj}\cdot z_{pi}$ is the amount of stretch of the second abstract mathematical spring;

1 is the length of a common line segment between cells i and j;

h is the thickness of the force pad.

To determine the total force on a pad node, the two previously determined abstract mathematical spring forces must be combined. If $f_i$ denotes the total force applied by an individual pad node i on a corresponding individual wafer node i, then when a pad node i and a corresponding wafer node i are not in contact, $f_i=0$. But when a pad node and a corresponding wafer node are in contact, $f_i$ is equal to the net force of all of the abstract mathematical springs attached to node i. Specifically, when the pad node and the corresponding wafer node are not in contact, $f_i=0$ and when in contact, the force at the intersection of a pad node and a wafer node is the summation of $F_{li}$ and the total of the $F_{2[i][j]}$ forces from adjacent nodes as represented below.

$$f_1 = F_{1i} + \sum_{j=1}^{M_1} F_{2[i][m_i(j)]}$$

Once the total force between a pad node and a wafer node has been determined, the erosion of the wafer surface or change in film thickness per unit time during the CMP process is modeled as the change in the z location or the vertical position of the oppositely positioned wafer node. The fraction $dz_{wi}/dt$ expresses the rate at which the height of a node on the surface of the wafer erodes. This erosion rate is modeled as a function of the net pressure $f_i$ on that wafer node by the equation:

$$dz_{wi}/dt=Ef_i$$

where E is a CMP_process erosion rate coefficient predetermined by a comparison to experimental data.

The overall vertical force of the pad on the wafer is defined as $F_p$. $F_p$ is equal to the sum of all the nodal forces $f_i$. Thus, if the parameters of the CMP process model are taken to be constant, the overall vertical force between the pad and the wafer $F_p$ is a function of $w_o$, the distance between plane W and plane P alone for any given moment in the CMP process simulation. Specifically, the further that the wafer is pressed into the polishing pad, the higher the force, $F_p$, will be. The actual CMP process down-force, defined as F, is part of the CMP process parameters supplied by the user of the algorithm. In typical CMP process applications, a down-force on the wafer holding device, $F_D$, is specified by the user. Since only a portion of the wafer is represented in the simulation, the actual process downward pressure, F, is taken to be the fraction of the downward force borne by the simulated pattern on the surface of the wafer and is therefore defined in the algorithm for the CMP process to be:

$$F = F_D\frac{A_{pattern}}{A}$$

where $A_{pattern}$ is the area of the simulated pattern and A is the total surface area of the wafer.

The CMP process simulation time is broken up into several very small time segments, commonly referred to as "time steps", each having a duration Δt.

The following variables are defined as:

1.) t=time

2.) n=number of pad nodes

3.) $t_{finish}$=t\The duration of the polish time

The overall CMP process simulation algorithm is divided into two main parts. They are as follows:

1.) Erosion Algorithm: The CMP process is taken through time, the distance between the planes W and P, $w_o$ is computed at each timestep, and the $z_w$ coordinate of the wafer node position throughout the CMP process is based on the nodal forces.

2.) Contact Force Algorithm: Given a value for the distance between planes W and P, $w_o$, the location of each of the pad nodes is first computed, the location of each node where the pad and wafer are in contact is then computed, the local force at the contacting nodes is computed next, and the sum, $F(w_o)$, of the local nodal forces is then computed across the surface where the pad contacts the wafer.

The steps used to employ the Erosion Algorithm and the Contact Force Algorithm are described below.

The steps used to employ the Erosion Algorithm are as follows:

1. Set the start time t=0
2. Set c, the initial number of pad and wafer nodes in contact, c, to empty
3. Set the end of the first time step to be t=t+Δt
4. Execute the following steps to determine the distance between planes W and P, $w_o$ the force between each pad node and each wafer node, $f_i$, and the total force of the pad on the wafer, $F_p(w_o)$ i=1,2,3, . . . n by:

4.1 Establish two guesses for $w_o$, the distance between planes W and P called $w_1$ and $w_r$ such that $w_l<w_o<w_r$, and such that $F_p(w_l)\,F_p(w_r)<0$, i.e., such that the true root $w_o$ is "bounded".

4.2 Estimate a guess for $w_o$ using the bisection, secant, Newton, or any other number of widely known root finding approaches. For example, in the bisection method, $w_o=(w_1+w_r)/2$.

4.3 Evaluate $F_p(w_r)$, $F_p(w_l)$, and $F_p(w_o)$.

4.4 Estimate a new guess for $w_l$ and $w_r$ using a bisection, secant, or any other number of widely known root finding techniques.

4.5 If the difference between $w_l$ and $w_r$ is sufficiently small or the difference between $F_p(w_o)$ and F is sufficiently small, continue to Step 5. Otherwise, repeat Step 4.2.

5. Decrease $z_{wi}$, i–1,2, . . . , n in the amount $Ef_i\Delta t$.

6. Let the initial number of nodes in contact $C=C_t$, the number of nodes in contact at time t.

7. If $t<t_{finish}$ resume at Step 3, otherwise STOP.

The steps of the Contact Force Algorithm are as follows:

1. Set the number of nodes in contact at time t, $C_t=C$, the number of initial nodes in contact.

2. Establish the following set of equations to obtain guesses, $z_{pi}$ for the vertical locations of the pad nodes. (Note that forces $F_{li}$ and $F_{2[i][j]}$ are purely functions of the pad node locations):

The force at the intersection of a pad node and a wafer node is:

$$F_{1i} + \sum_{j=1}^{M_1} F_{2[i][m_i(j)]} = 0, \text{ if } i \in C_i$$

and the vertical position of pad node i is:

$$z_{pi}=w_o-z_{wi} \text{ if } i\epsilon C_t$$

3. Solve the set of simultaneous algebraic equations using any number of widely known algebraic equation solving techniques. For the example where an abstract mathematical model of linear springs is used, the Gauss-Seidel (Matrix Solving or Linear System solving) method, the Jacobi method, the Conjugate method, the Gradient method, or the Gassian Elimination Method provide suitable simultaneous equation solution techniques.

4. For each node, i=1, 2, 3, . . . , n, if the vertical position of a pad node, $z_{pi}>w_o-z_{wi}$, the vertical position of a wafer node, then $C_t=C\cup i$, else $C_t-C5-\{i\}$ 5. If the number of nodes in contact at time t $C_t$ changed during Step 4, resume at Step 2. Otherwise proceed to Step 6.

6. Compute the force at the intersection of a pad node and a wafer node $$f_i = F_{1i} + \sum_{j=1}^{N_1} F_{2[i][m_i(j)]} \text{ if } i \in C_i \;\; f_i = 0 \text{ otherwise}$$

7. Compute the total force on the polishing pad.

$$F_p = \sum_{j=1}^{n} f_1$$

8. Stop

During step 60 in FIG. 7, the CMP process model 10 preferably obtains at least a wafer scale uniformity simulation result and a feature scale planarity simulation result for the current workpiece. In an exemplary embodiment of the present invention, the wafer scale uniformity simulation result includes a simulated film thickness profile and the feature scale planarity simulation result includes a simulated local pattern profile. The simulated film thickness profile may be utilized to derive the global wafer scale uniformity information, and the local pattern profile may be used to derive the local feature scale planarization information. The global wafer scale uniformity information is related to the simulated film thickness calculated at the various sampling points, while the feature scale planarity information is related to the localized flatness of the pattern at particular locations on the wafer surface. The feature scale simulation step, which may be performed by the pseudo-physical CMP process model 10 to obtain the feature scale planarity simulation result, is described in more detail below. The simulated CMP result may then contain additional information related to the wafer characteristics and the simulated CMP process result may be formatted or expressed in any suitable manner for maximum utility.

System Output

Figure 8A:
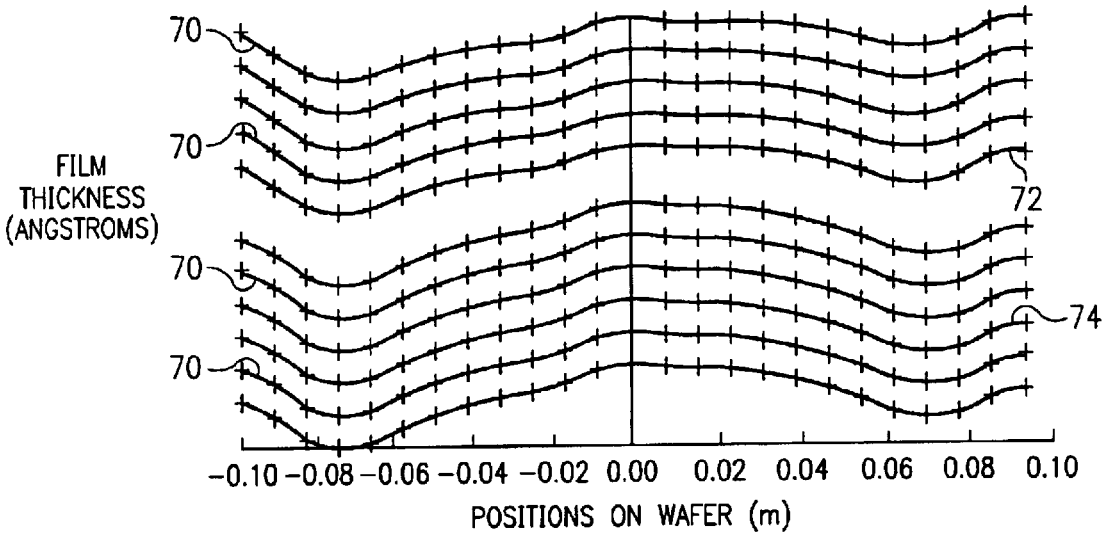
FIG. 8A is an exemplary wafer scale simulation result.
Figure 8B:
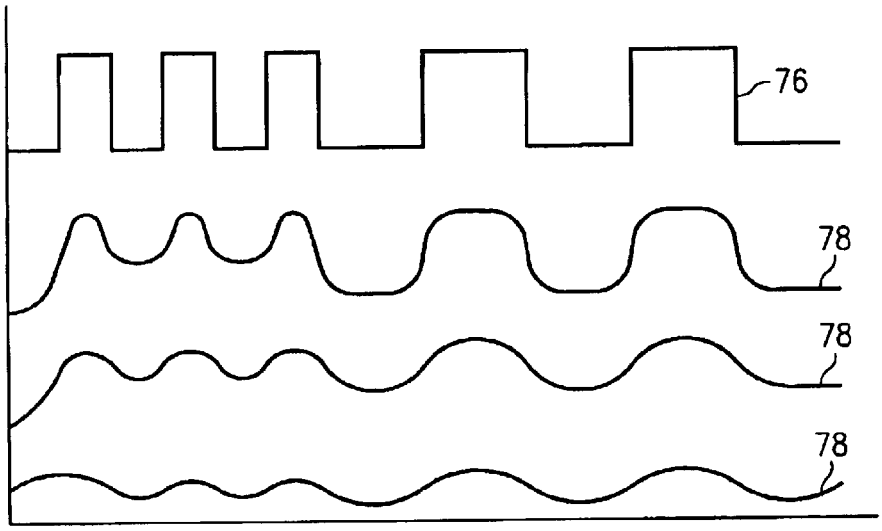
FIG. 8B is an exemplary feature scale simulation result.

After the modeling routine 60 in FIG. 7 is completed for the wafer (or after several modeling runs are completed over a particular time period), a final step 62 causes the pseudo-physical CMP process model 10 to produce a suitable output for review by the user. In the preferred embodiment, step 62 produces an output indicative of the wafer scale simulation result and/or the feature scale simulation result. FIG. 8A is an exemplary wafer scale simulation result (e.g., a film thickness profile) produced by the pseudo-physical CMP process model 10. FIG. 8B is an exemplary feature scale simulation result.

Each plot 70 in FIG. 8A represents the film thickness at certain locations on the surface of the wafer, e.g., sample points taken along the diameter of the wafer. Different plots 70 for the same simulation may be associated with the predicted condition of the wafer at different processing times. For example, a plot 72 may represent the film thickness at time t, while another plot 74 may represent the film thickness at a future time t+t'.

After final step 62 produces one or more outputs related to the CMP process modeling results, the CMP process simulation program 24 ends. It should be appreciated that the CMP process simulation program 24 may continue with any number of additional tasks and that the CMP process simulation program 24 may be incorporated into one or more comprehensive processes utilized by the pseudo-physical CMP process model 10 or the actual CMP system 12.

Feature Scale Simulation Output

FIG. 8B is an exemplary feature scale simulation result (e.g., a local pattern profile) produced by the pseudo-physical CMP process model 10. This particular simulation result includes an initial user-defined feature scale pattern 76, e.g., the original pattern on the surface of the wafer put in during step 58 (see FIG. 7) or a derivative thereof. The CMP process simulation result may also include one or more plots 78 representing various stages during the simulated CMP process. Such CMP process simulation results may be utilized to determine the effect that CMP process parameters have on the local planarization of the surface of the wafer.

Figure 10:
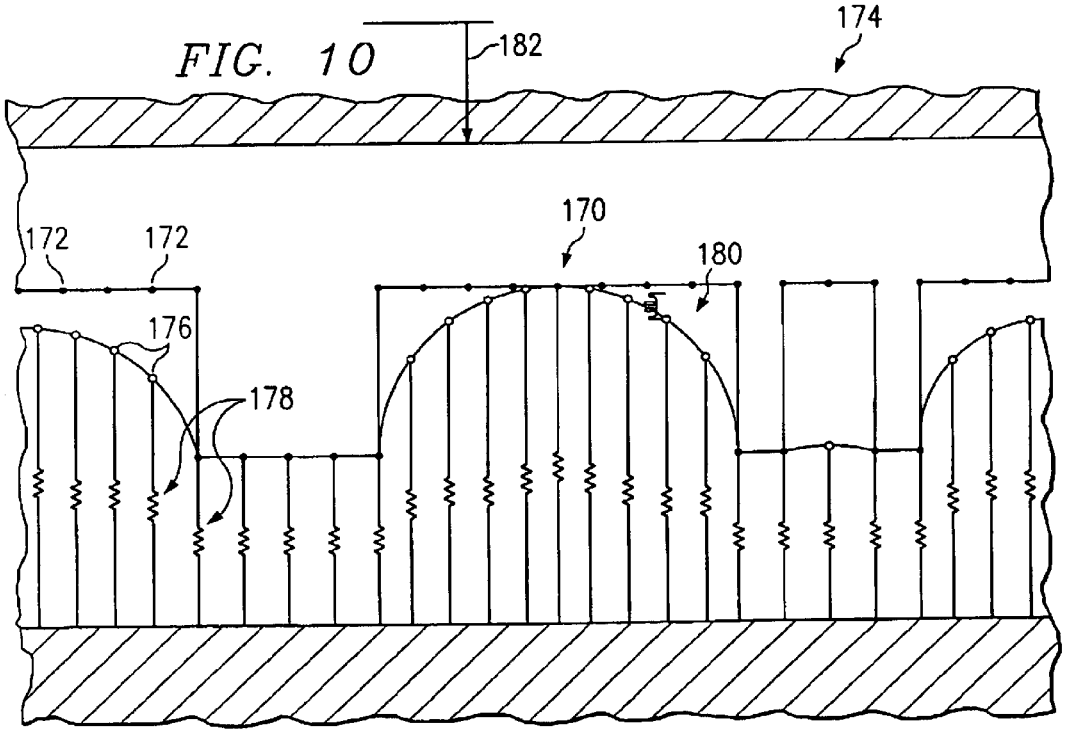
FIG. 10 is a schematic diagram of a modeled dielectric pattern and a corresponding deformation model.
Figure 9:
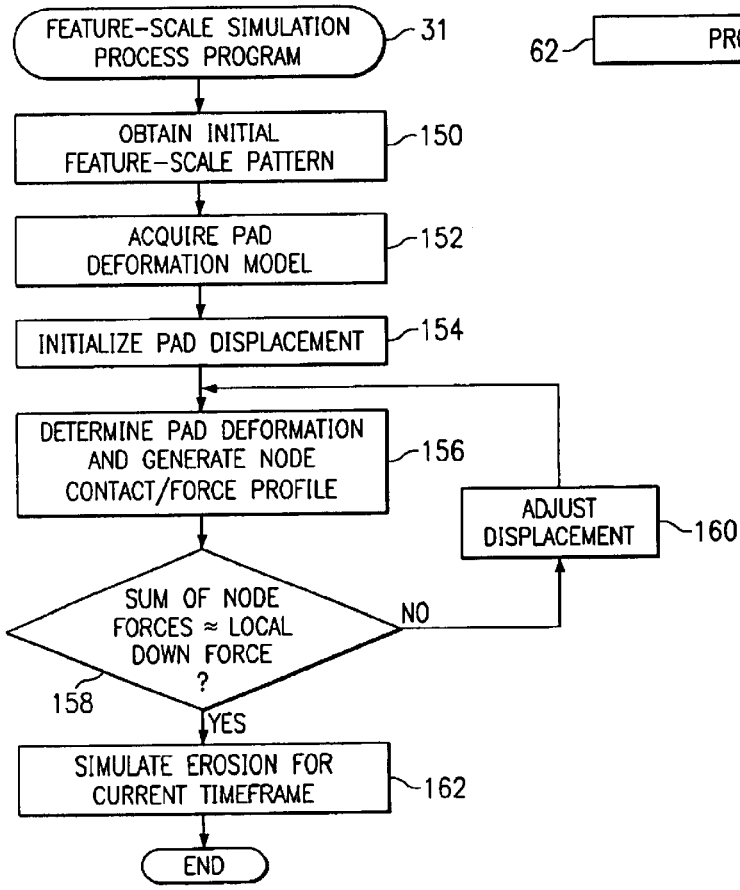
FIG. 9 is a flow diagram of the feature scale simulation process.

FIG. 9 is a flow chart which depicts the feature scale simulation process 31. The feature scale simulation process 31 may be performed by the pseudo-physical CMP process model 10 during the execution of the CMP simulation process program 24. The feature scale simulation process 31 begins with a step 150, which causes the pseudo-physical CMP process model 10 to obtain the initial feature scale pattern associated with the surface of the workpiece. As described above in connection with step 58 (see FIG. 7), the initial feature scale pattern may be stored in the computer memory 22 for subsequent access during the execution of the feature scale simulation process 31. Referring now to FIG. 10, an exemplary feature scale pattern 170 is illustrated. This feature scale pattern 170 is shown as if the wafer is face-down in a position ready for polishing by a polishing pad stack (see FIG. 1). As shown, the feature scale pattern 170 is preferably represented by a plurality of nodes 172 which are connected by line segments for the purpose of simulating the CMP process in accordance with the present invention. The spacing between the nodes 172 may be selected in any suitable manner, e.g., to provide a sufficiently accurate model of the feature scale pattern 170.

Pad Deformation Model Output

Referring back to FIG. 9, a step 152 is performed to apply the mathematical model of the deformation of the polishing element, e.g., the polishing pad stack used by the actual CMP system 12. The preferred model of pad deformation is based upon the physical characteristics of the polishing pad acting like abstract mathematical springs connected together in series (FIG. 5). An exemplary mathematical model 174 of a deformation pad is shown in FIG. 10 where the modeled pad, when in its deformed state, closely simulates the characteristics of a polishing element used in an actual CMP system 12. In the preferred embodiment, the mathematical model 174 of the polishing element is defined at individual pad nodes 176 that correspond (relative to the horizontal axis) to individual wafer nodes 172. Further, the mathematical pad deformation model 174 assumes that adjacent nodes 176 on the pad are connected together by line segments.

At any given time during the CMP process simulation, the feature scale pattern 170 on the surface of the wafer is considered to be rigid (not deformed) and the polishing pad is considered to be deformable in accordance with the mathematical model 174. The mathematical model of pack deformation 174 is preferably defined by a plurality of primary force/displacement elements 178 (abstract mathematical springs) that are capable of compressing in response to a load. In the exemplary embodiment shown in FIG. 10, each primary force/displacement element 178 in the pad is associated with one of the pad nodes 176. Each primary force/displacement element 178 in the pad may then be "linked" or otherwise associated with at least one additional adjacent primary force/displacement pad element 178. In the preferred embodiment, the primary force/displacement elements 178 in the pad are then "coupled" to each of their adjacent primary force/displacement elements 178 via secondary force/displacement elements 180. While any number of modeling parameters may be employed to characterize the primary and secondary force/displacement pad elements 178, 180—in the preferred embodiment the displacement pad elements 178, 180 are physically modeled to function as linear springs.

After step 152 (FIG. 9) acquires the pad deformation model 174, a step 154 is preferably performed to initialize a displacement 182 of the wafer relative to the polishing pad. In practice, the displacement 182 of the wafer may relate to an amount of downward travel of the wafer carrier during the CMP procedure. The initial static displacement of the wafer with respect to the polishing pad stack may be set at any suitable value. In response to this initial static wafer displacement, a step 156 causes the pseudo-physical CMP process model 10 to determine (by simulation) the deformation of the polishing element. During the execution of step 156, the pseudo-physical CMP process model 10 may suitably generate a simulated contact profile between the wafer and the pad and/or a localized force profile associated with the pad deformation model 174 in relation to the current state of the feature scale pattern 170 on the wafer. The contact profile between the surface of the wafer and the pad may identify which nodes 172 of the feature scale pattern 170 on the surface of the wafer are in contact with the corresponding nodes 176 of the pad deformation model 174. As shown in FIG. 10, some parts of the simulated pad may not be in contact with corresponding parts of the wafer, and the secondary force/deflection elements 180 may limit the extension of some of the primary force/deflection elements 178 that would otherwise be extended to contact the simulated pattern on the surface of the wafer. The force profile may then identify the amount of localized force that is imposed upon the nodes 172 of the feature scale pattern on the surface of the wafer by the nodes 176 of the pad deformation model by analyzing the appropriate pad force/deflection elements 178, 180 with respect to the pad displacement 182.

Contact Profile Computation

The contact profile between the wafer and the polishing pad is preferably computed by utilizing a static force equilibrium equation at each node of the pad deformation model 176. For any given pad node, the downward displacement of its primary force/deflection element induces a corresponding upward force, just like a linear spring. The greater the displacement—the greater the force. The relative displacement of this pad node with respect to its adjacent pad nodes induces additional forces (either upward or downward, depending on the relative position of the pad node to its adjacent node). The pseudo-physical CMP process model 10 preferably assumes that the summation of the nodal forces for any given nodal contact between the pad and the wafer is equal to zero. When summation of the nodal forces equaling zero is imposed mathematically for any given pad node, an equation in terms of the displacement of the given pad node and the displacement of those pad nodes adjacent to the given pad node is formed. Combining such equations for each one of the pad nodes 176 of the pad deformation model produces a set of simultaneous algebraic equations which mathematically represents the displacement of the pad nodes 176 in the pad deformation model. In that set of simultaneous algebraic equations, the force-balance equation for any node on the polishing pad that has previously been determined to be in contact with a corresponding node on the wafer is replaced with an equation holding that the vertical position of a node on the polishing pad is equal to the vertical position of a corresponding node on the wafer at that point.

After the set of simultaneous algebraic equations has been solved, the displacement of each node on the pad is examined. If the position of a node on the polishing pad is determined to be higher than that of the position of a corresponding node in the wafer at that point, then the node position in the polishing pad is automatically set to be equal to the node position of the wafer and this node is identified as a "possible contact node." The set of simultaneous algebraic equations is then solved once again—this time replacing the force balance equation for each "possible contact node" with a specified pad displacement relative to plane P. The specified pad displacement is the position of the wafer surface relative to plane W at that node. Similarly, if the vertical position of a node on the polishing pad, previously thought to be a "possible contact node," and then later is determined not to be in contact with a corresponding node on the wafer, then that pad node is removed from the list of "possible contact nodes" and its corresponding position equation is replaced with the force balance equation. Solving the set of simultaneous algebraic equations and then subsequently determining "possible contact nodes" is repeated until no changes occur between iterations. At that point, the "possible contact nodes" of the polishing pad are determined to be in contact with the corresponding wafer nodes and are identified as "contact nodes." The force imposed on the wafer nodes by each contact node of the polishing pad is then computed using the force relationships associated with the primary and the secondary force/deflection elements 178, 180 at each pad node.

Updated Displacement Model

After step 156 generates an appropriate force profile for the current displacement 182, a quaere step 158 is then performed. The quaere step 158 compares the sum of the node forces contained in the localized force profile to the current (or simulated) down force associated with the particular area of the wafer being analyzed. This current (or simulated) down force may be a user-defined quantity or it may be derived from a known carrier down force associated with the entire wafer and the known area of the wafer under analysis. If the quaere step 158 determines that the sum of the nodal forces does not substantially equal the local down force (or, alternatively, if the difference between the sum of the nodal forces and the current (or simulated) down force does not fall within a desired tolerance), then a subsequent step 160 is performed to adjust the pad displacement 182 by a suitable amount. The adjustment of the pad displacement 160 causes a change in the pad deformation model 174, the current contact profile, and the current localized force profile. Accordingly, step 156 and the quaere step 158 are preferably repeated for the updated pad displacement 182.

Steps 156, 158, and 160 preferably form a processing loop that causes the pad displacement 182 to be adjusted in a suitable manner until the quaere step 158 determines that the sum of the node forces on the polishing pad is approximately equal to the local down force applied to the wafer. If these forces substantially balance, then a step 162 is performed to cause the pseudo-physical CMP process model 10 to simulate the erosion of the wafer for a given time period using the differential equation for $dT_i/di$ shown above. In the preferred embodiment, the erosion of the wafer surface is simulated by adjusting the positions of the appropriate nodes 172 of the feature scale pattern on the wafer surface by an amount that may be dependent upon the current CMP process parameters, such as: the slurry composition, the wafer composition, and the like. Thus, for a given time, soon after CMP processing begins, a local pattern on the wafer surface may closely resemble the original wafer surface pattern (see FIG. 10). At a later time, the pseudo-physical CMP modeling system 10 may leverage historical simulation data to enable the simulation of the erosion of the wafer surface during the CMP process over time. For example, a subsequent iteration of the feature scale simulation process 31 may utilize a partially planarized version of the wafer surface pattern rather than the initial wafer surface pattern described above in connection with step 150 (FIG. 9).

Optimization Process

FIG. 11 depicts the CMP optimization process program 28 that may be performed by the pseudo-physical CMP process model 10 to generate a preferred set of CMP process parameters for use during an actual CMP procedure. The CMP process parameters are preferably optimized to produce a CMP recipe in response to a desired CMP result. The optimization process 28 may be carried out in conjunction with the CMP process 24 or as a separate and distinct process.

The CMP optimization process program 28 preferably begins with an initial step 86 which causes the pseudo-physical CMP process model 10 to retrieve a current simulated CMP result from, e.g., database 44 located in the memory 22 (see FIG. 6). Following step 86, another step 88 is performed to retrieve the optimization parameters for the CMP optimization process 28. These optimization parameters may be retrieved from the database 40. In the context of this description, an optimization parameter may be any characteristic, quantity, or feature associated with an "ideal" wafer as processed by the actual CMP system 12. The preferred embodiment of the pseudo-physical CMP process model 10 may include any number of optimization parameters related to: the initial feature scale pattern; the initial film thickness profile; the relative importance of wafer uniformity versus wafer planarization; or the intended planarization or uniformity result. All of these parameters may be user-defined.

Following the completion of a step 88, a subsequent step 90 is performed to cause the pseudo-physical CMP process model 10 to compare the characteristics of the current simulated CMP result to the corresponding characteristics indicated by the optimization parameters. For example, in the context of feature scale planarity, step 90 may analyze an error between the intended pattern on the surface of the wafer and the simulated pattern, which error is contained in the current simulated CMP results. Similarly, with respect to wafer scale uniformity, step 90 may analyze the difference between the intended film thickness and the simulated film thickness measurements.

A quaere step 92 is preferably performed to determine whether the error between the simulated CMP result and the intended CMP result has been substantially minimized. The CMP optimization process 28 may utilize any number of techniques to analyze the simulation error, e.g., curve fitting, least-squares, averaging, and the like. If the quaere step 92 determines that the simulation error is substantially minimized, then the current simulation is considered acceptable and the quaere step 92 may prompt another step 94, which both saves and displays the current CMP process parameters. Following the completion of step 94, the CMP optimization process 28 ends. The operator may then apply the optimized CMP process parameters to the actual CMP procedure. If the quaere step 92 finds that the difference between the simulated and the intended CMP results have not been minimized, then a step 96 may be performed to cause the pseudo-physical CMP modeling system 10 to adjust at least one of the CMP process parameters. For example, step 96 may vary the polish table speed, the wafer carrier down force, the polish time, the dimensions or sweep range of the carrier, or the like. Step 96 may also hold one or more CMP process parameters fixed (in response to a user input or automatically) to simplify subsequent processing.

After step 96 adjusts the initial CMP process parameters, step 98 causes the pseudo-physical CMP modeling system 10 to perform the modeling routine with the updated CMP process parameters in place. The modeling routine was described above in connection with FIG. 9. Steps 90 and 92 are repeated to analyze the new simulated CMP result. In this manner, steps 90, 92, 96, and 98 form a processing loop during which one or more of the CMP process parameters are optimized in accordance with the intended CMP results. The particular set of CMP process parameters may be saved in a database 34 (see FIG. 6) for future reference or to initialize a subsequent CMP process optimization routine.

Those skilled in the art will appreciate that the CMP optimization process 28 (or a modified version thereof) may be employed to optimize those CMP process parameters related to a theoretical CMP system. Such simulations may facilitate the design and development of new CMP systems without the cost and labor associated with actual experimentation and prototyping. For example, after a particular CMP procedure has been optimized for an existing CMP system, the CMP optimization process 28 may be performed to vary at least one of the optimized CMP process parameters to thereby define an updated CMP process parameter set. Then, a second simulated CMP result may be obtained using the updated CMP process parameters. In this manner, an operator can efficiently simulate and optimize the performance of a new CMP system prior to building an actual prototype.

It should be noted that the CMP optimization process 28 is not limited to the particular optimization protocol described above. Indeed, the CMP optimization process 28 may utilize any suitable optimization technique to accomplish the same results. For example, the CMP optimization process 28 may utilize minimization or maximization methodologies to optimize one or more values associated with quantifiable CMP results. In the preferred embodiment, the CMP optimization process 28 may endeavor to maximize the quality of the CMP result by adjusting the CMP process parameters in accordance with the following technique. A quality measurement (O) is defined as follows: (Q)=( )(uniformity)+(l−) (planarity), where the user selects a value for (the relative importance of uniformity compared to planarity) between zero and one. Thus, the CMP optimization process 28 may iteratively adjust the CMP process parameters to maximize Q, subject to the particular value of Model Validation Process In the preferred embodiment, the pseudo-physical CMP modeling system 10 is capable of validating one or more of the processing parameters associated with a simulated CMP result such that the error between the simulated CMP result and the empirical CMP result (using the same CMP process parameters) is substantially minimized. Such model validation is desirable to determine whether a given CMP model can reproduce experimental data through manipulation of one or more of its modeling parameters, to establish rules for computing the modeling parameters for new configurations, and to determine the reliability of such rules and the accuracy of the CMP simulations.

FIG. 12A is a simplified flow diagram illustrating that a partially polished wafer is measured to validate the mathematical model and obtain updated CMP process settings to be plugged back into the CMP process model to refine its output.

Figure 12B:
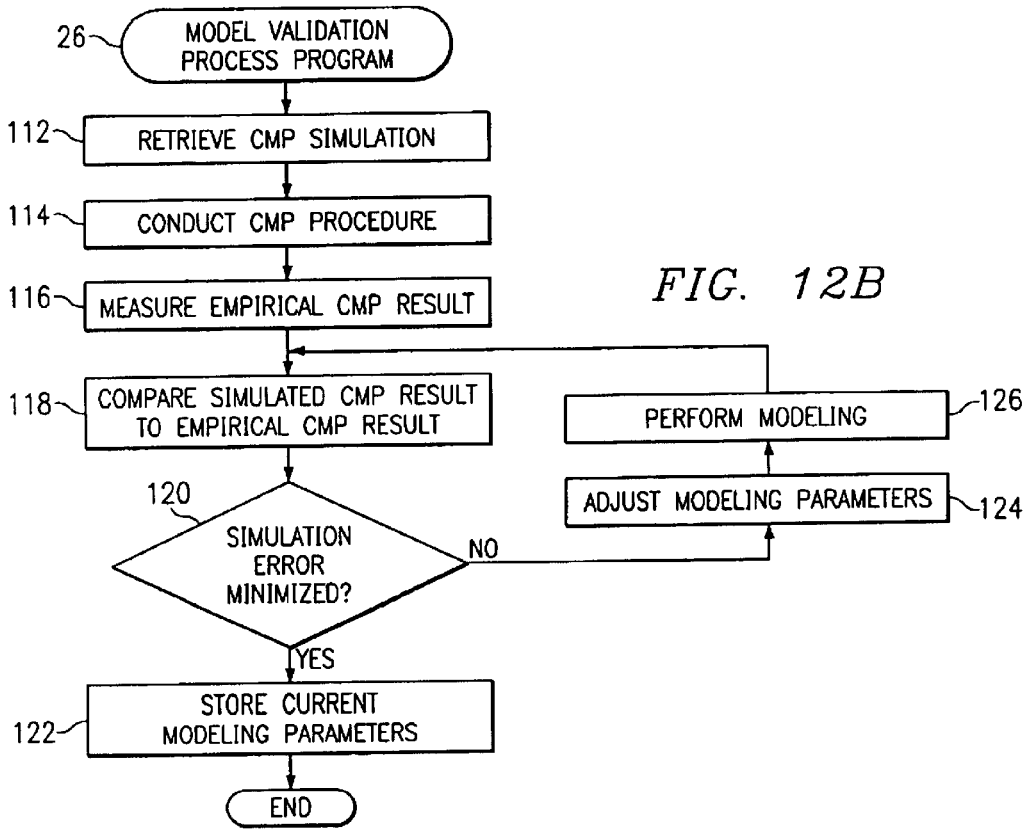
FIG. 12B is a flow diagram of the CMP process model validation.

FIG. 12B is a detailed flow diagram of the model validation process 26 that may be performed by the pseudo-physical CMP process model 10. Generally, the model validation process 26 enables the pseudo-physical CMP process model 10 to validate its CMP simulation results by comparing the simulated results to corresponding empirical results and then adjusting one or more of the modeling parameters to increase the accuracy of the simulation. Thus, the pseudo-physical CMP process model 10 may be configured to leverage historical empirical data to improve the overall performance of the CMP process simulations. The model validation 26 may be performed for any number of modeling parameters and for different CMP process parameters to enable accurate simulations for a wide variety of different CMP processing recipes.

The model validation process 26 begins with step 112, which causes the pseudo-physical CMP process model 10 to retrieve a particular or current CMP simulation. Step 112 is similar to step 86 described above in connection with FIG. 11. The CMP simulation retrieved during the execution of step 112 is generated by the pseudo-physical CMP process model 10 in accordance with the present invention. An actual run of a CMP procedure is conducted during the execution of step 114. This CMP procedure is performed by the actual CMP system 12 in accordance with the CMP process parameters designated during the corresponding CMP simulation. Step 114 may be performed in response to control signals from the pseudo-physical CMP process model 10 or in response to operator inputs to the actual CMP system 12. In addition, step 114 may be performed in an interactive manner as the pseudo-physical CMP process model 10 produces a substantially real-time CMP simulation.

Following step 114 a step 116 may be performed to measure an empirical CMP process result associated with the wafer polished during the execution of the actual CMP procedure. The empirical CMP process result is preferably stored in a database 42 (see FIG. 6) for subsequent use by the pseudo-physical process model 10. In the preferred embodiment, step 116 may be performed by a measurement system incorporated into the actual CMP system 12 and the pseudo-physical CMP process model 10, or by one or more separate measurement systems. The actual CMP system 12 may include any number of in-situ wafer surface measurement devices to facilitate substantially real-time optimization of one or more of the CMP process parameters in response to the current simulation results. Such measurement devices (and other suitable wafer surface measurement systems) may be employed for purposes of executing step 116. Such surface measurement systems and devices are well known to those skilled in the art and accordingly are not described in detail herein.

Step 116 preferably measures at least the global wafer scale uniformity of the processed wafer (derived from a film thickness profile) and the local feature scale planarity of the processed wafer (derived from a local feature pattern profile). Thus, step 116 obtains an empirical CMP result that contains a wafer scale empirical CMP result and a feature scale empirical CMP result. The global wafer scale uniformity may be derived by measuring the film thickness at a number of points on the surface of the wafer. In an exemplary embodiment, the film thickness profile is measured with a thin-film thickness measurement system, such as Optiprobe system. The local planarity may be derived by scanning the surface of the wafer and analyzing the small scale features. For example, the preferred embodiment utilizes a surface profile measurement system which is commercially available as a stand alone system. Other suitable techniques may be utilized during step 116 to measure uniformity, planarity, or other characteristics of the wafer, e.g., systems that employ reflective or refractive optics or systems that employ micrometer or observational techniques. For the sake of compatibility, the measurement points preferably correspond to the sampling points used by the pseudo-physical CMP process model 10 to produce the current simulated CMP result.

After step 116 obtains the requisite amount of empirical CMP data, a step 118 is performed to compare the simulated CMP result to the empirical CMP result. In practice, the pseudo-physical CMP process model 10 may compare the simulated and empirical film thickness profiles and the simulated and empirical local feature profiles. During step 118, the actual wafer scale empirical CMP result and the actual feature scale empirical CMP result are compared to their respective simulated counterparts. The pseudo-physical CMP process model 10 may use any suitable comparison technique during task 118 to compare the empirical and simulated results. For example, the various sampling points may be analyzed on an individual basis or a plurality of sampling points associated with a given measurement may be processed in a collective manner. Alternatively, step 118 may employ any number of conventional curve fitting techniques, least-squares techniques, or the like.

In accordance with an exemplary embodiment of the CMP process model 10, a quaere step 120 is performed after the empirical and simulated CMP results have been obtained. The quaere step 120 determines whether a simulation error (which may be obtained during step 118) is substantially minimized. Such a simulation error may be determined for individual sampling points or for a collected or averaged quantity with a number of sampling points. For example, in the preferred embodiment, the difference is mathematically determined by summing the individual differences between the simulated and empirical results at various data points. The sum of these individual differences is dependent upon the values of the modeling parameters used by the pseudo-physical CMP process model 10.

If the quaere step 120 determines that the current simulation error has been minimized, then a step 122 is performed to store the current CMP process parameters for use with a subsequent CMP modeling routine. In other words, the optimized CMP process parameter set may be used to conduct future simulations in a confident manner. The optimized CMP process parameters may be stored in a database 36 of the memory 22 (see FIG. 6). After the completion of step 122, the model validation process 26 ends. It will be appreciated by those of ordinary skill in the art that the model validation process 26 may be performed in conjunction with the CMP optimization process 28 (FIG. 11) in an iterative or combined manner to obtain optimized CMP process parameters for a given CMP procedure.

If quaere step 120 determines that the current simulation error is unacceptable, then the model w validation process 26 leads to a step 124. Step 124 causes the pseudo-physical CMP process model 10 to adjust at least one CMP process parameter to obtain an updated CMP process parameter set. The pseudo-physical CMP process model 10 may be suitably configured to systematically adjust the CMP process parameters in a number of ways and in any order. Step 124 may also cause the pseudo-physical CMP process model 10 to hold at least one of the CMP process parameters fixed during the adjustment procedure to facilitate efficient and speedy optimization. The specific CMP process parameters to be fixed may be designated by the user prior to the model validation process 26, during the model validation process 26, or by default. It should be noted that, because the simulation error is dependent upon the various CMP process parameters, the model validation process 26 is reduced to a multi-variant optimization problem.

Following step 124, a step 126 preferably causes the pseudo-physical CMP process model 10 to perform a subsequent modeling routine to obtain an updated simulated CMP result associated with the updated CMP process parameters. Step 126 is similar to step 98, described above, in connection with FIG. 11. After step 126 obtains the new simulated CMP result, the model validation process 26 is re-entered at step 118 to re-compare the empirical CMP result with the updated simulated CMP result. Thus, steps 118, 120, 124, and 126 are preferably repeated until the error between the simulated CMP result and the empirical CMP result has been substantially minimized. In other words, the simulated CMP result is altered until a "best fit" relative to the empirical CMP result has been obtained. This processing loop causes the pseudo-physical CMP process model 10 to self-optimize its CMP process parameters such that the simulated CMP result substantially matches the empirical CMP result. Although the present invention employs non-linear regression techniques to optimize the CMP process parameters, any number of suitable methodologies may be utilized to determine the particular CMP process parameters used for a given simulation.

Interpolation Formula Generation Process

Figure 13:
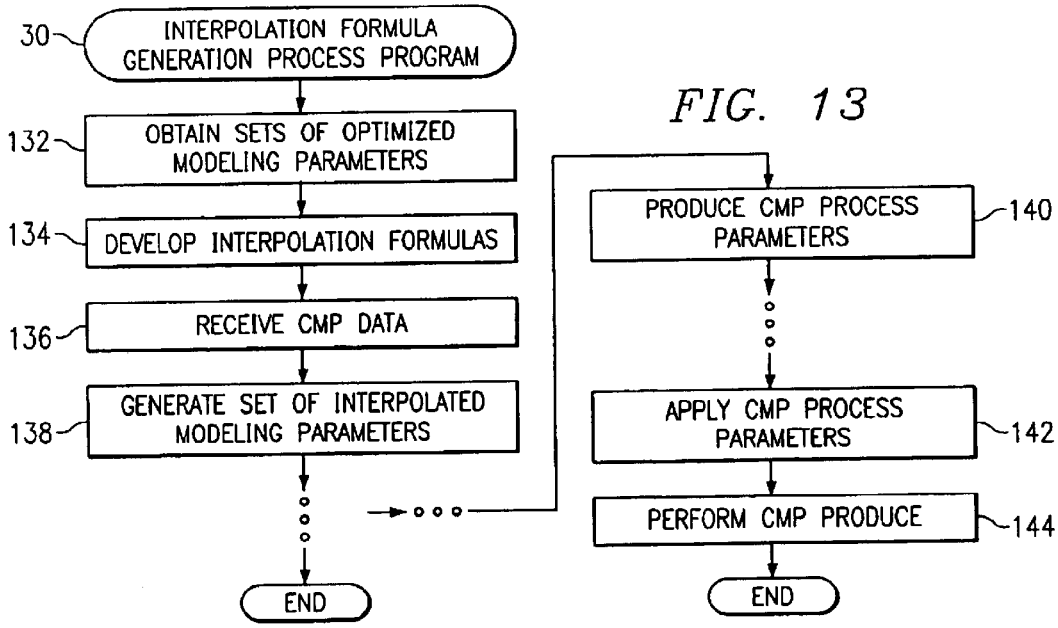
FIG. 13 is a flow diagram of the interpolation formula generation process.

FIG. 13 is a flow diagram of the interpolation formula generation process 30 performed by an exemplary embodiment of the pseudo-physical CMP process model 10. The interpolation formula generation process 30 preferably begins with a step 132, during which step the pseudo-physical CMP process model 10 obtains a plurality of optimized CMP process parameter sets, each set being associated with a pre-determined set of CMP process parameters. In other words, each of the optimized CMP process parameter sets is configured for use with the CMP modeling routine to obtain a simulated CMP result for a wafer processed during the CMP procedure using a set of pre-determined CMP process parameters. The optimized CMP process parameters are preferably obtained during the model validation process 26 (see FIG. 12B) or by an equivalent CMP process parameter estimation technique. Task 132 may obtain the optimized CMP process parameters from database 36 (see FIG. 6).

Step 132 leads to a step 134, which causes the pseudo-physical CMP process model 10 to develop a plurality of interpolation formulas associated with the optimized CMP process parameter sets. The interpolation formulas may be utilized by the pseudo-physical CMP process model 10 to predict CMP process parameter values for new and untested sets of various CMP process parameters. Those skilled in the art will appreciate that any number of methods may be used to form the interpolation rules for the CMP process parameters. The most straightforward manner is to simply express each CMP process parameter as a linear or as a quadratic function. Such a methodology may be acceptable when a large amount of empirical data is accumulated to encompass an adequate number of CMP procedures. However, this procedure may not be adequate when a limited amount of empirical data exists.

The preferred embodiment endeavors to generate interpolation formulas associated with those CMP process parameters that dictate performance and/or provide for reliable interpolation rules for the other CMP process parameters. One technique that accomplishes this goal limits the number of variable CMP process parameters to the following:

T=table speed

C=carrier speed

F=carrier down force

The pseudo-physical CMP process model 10 uses a combination of these parameters for interpolating the CMP process parameters; this combination is defined as II, where:

$$II=T^{e_1}C^{e_2}(T-C)^{e_3}F^{e_4}$$

If $x^2$ is an objective function of a minimization problem and $x^2=(e_1, e_2, e_3, e_4)$ then an interpolation rule may be obtained by calculating the different possible combinations and analyzing $x^2$. As an approximation to this approach, the exponents can be restricted to the values −1, 0, or 1 (with $e_3 \neq 1$). The best overall "fit" is then selected for purposes of this interpolation formula.

After the interpolation formulas are adequately developed in step 134, a step 136 may be performed such that the pseudo-physical CMP process model 10 receives CMP data associated with a particular CMP procedure. As described above, this CMP data may be related to the CMP process parameters and/or the intended CMP results (e.g., uniformity versus planarity balance, wafer pattern, or the like). Step 136 may be performed in response to user-defined inputs or in accordance with other instructions received by the pseudo-physical CMP process model 10.

A step 138 is preferably performed in response to the CMP data received in step 136. Step 138 causes the pseudo-physical CMP process model 10 to generate an interpolated modeling parameter based upon the current CMP data. Step 138 utilizes one or more interpolation formulas to generate the interpolated modeling parameters for the given CMP data. Following step 138, the interpolated formula generation process 30 may end. The interpolated CMP process parameters may then be stored or immediately used to obtain a simulated CMP result for the specified CMP procedure.

As depicted by the ellipses and the connecting arrow in FIG. 13, a step 140 (which may be performed at a later time or in connection with a separate process) may be performed to produce a plurality of CMP process parameters in response to an intended CMP result, where the CMP process parameters are obtained through the optimization procedures described above, which procedures involve the use of the interpolation formulas. Thus, the interpolated formula generation process 30 (or a related process) maybe performed by the pseudo-physical CMP process model 10 to obtain suggested CMP process parameters for an untested CMP procedure if an intended CMP result is known beforehand.

Utilization of CMP Process Parameters

The CMP process parameters obtained during step 140 may be subsequently (or substantially concurrently) applied to the actual CMP system 12, as depicted in a step 142 related to the interpolated formula generation process 30. Step 142 may cause the pseudo-physical CMP process model 10 to communicate the CMP process parameters to the CMP controller 32 with the actual CMP system 12 (see FIG. 6). Alternatively, an operator may make a record of the CMP process parameters and adjust the actual CMP system 12 in an appropriate manner to effect the desired settings for CMP process parameters. Following step 142, a step 144 causes the actual CMP system 12 to perform a CMP procedure in accordance with the set of CMP process parameters produced during step 140. Step 144 is similar to step 114 described above in connection with FIG. 12B. Following step 144, the process 30 ends. As described above, the empirical CMP results obtained during step 144 may be used during the model validation process 26 (FIG. 12B).

Other Embodiments

In summary, the present invention provides an improved CMP mathematical model for a CMP process model that is capable of providing both wafer scale uniformity simulations and feature scale planarity simulations. The disclosed CMP modeling system can generate an optimized set of CMP process parameters based on a specified balance between wafer uniformity and planarity. In addition, the pseudo-physical CMP process model computes its modeling coefficients in accordance with empirically determined CMP results to thereby reduce simulation errors. The pseudo-physical CMP process model employs interpolation techniques to its modeling parameters to effectively simulate CMP results for which little or no empirical data exists, and it can process simulation data collected for an existing CMP system to assist in the design of a new CMP system having different physical and processing characteristics than the existing CMP system.

The present invention has been described above with reference to preferred exemplary embodiments. However, those skilled in the art will recognize that changes and modifications may be made to the preferred embodiment without departing from the scope of the present invention. For example, the present invention is not limited to the particular modeling, optimization, or interpolation techniques described herein. In addition, the various hardware components may differ than that shown and described herein and the various processes need not be performed in the precise manner described therein. These and other changes or modifications are intended to be included within the scope of the present invention, as expressed in the following claims.

What is claimed is:

1. A method for pseudo-physically modeling the erosion of the surface of a workpiece being polished by a stack of polishing pads including a base pad and a top pad, said method comprising the steps of:

a) determining the contact force between the surface of the workpiece being polished and the stack of polishing pads by:

1) equating the base pad to a first abstract mathematical spring having compressibility factor k1;

2) equating the top pad to a second abstract mathematical spring having compressibility factor $k_2$;

3) said first and second abstract mathematical springs being connected together in series;

4) determining the force on the stack of polishing pads by determining the combined deflection of the base pad and the top pad;

b) equating the force on the stack of polishing pads to the force on the surface of the workpiece being polished;

c) determining the erosion rate of the surface of the workpiece being polished by multiplying the force on the surface of the workpiece being polished by a predetermined constant.

2. The method for pseudo-physically modeling as defined in claim 1 wherein a compressibility factor $k_1$ is selected for a predetermined erosion rate of the surface of the workpiece.

3. The method for pseudo-physically modeling as defined in claim 1 wherein a compressibility factor $k_2$ is selected for a predetermined erosion rate of the surface of the workpiece.

4. The method for pseudo-physically modeling as defined in claim 1 wherein said force on the surface of the workpiece being polished is selected for a predetermined erosion rate of the surface of the workpiece.

5. The method for pseudo-physically modeling as defined in claim 1 wherein the force on the stack of polishing pads is obtained by dividing the stack of polishing pads and the surface of the workpiece being polished into a plurality of individual nodes i.

6. The method for pseudo-physically modeling as defined in claim 5 wherein each node i of the stack of polishing pads has an adjacent node j.

7. The method for pseudo-physically modeling as defined in claim 6 wherein:

the spring force on a node i in the base pad is the product of said compressibility factor $k_1$, the deflection of the base pad, and the area of said node i, and wherein the spring force on a node i in the top pad is the product of said compressibility factor $k_2$, the deflection of the top pad, the length of contact between node i and an adjacent node j and the thickness of the top pad.

8. The method for pseudo-physically modeling as defined in claim 6 wherein:

the force $F_{1i}$ from a base pad node is computed using the formula:

$$F_{1i}=-rk_1(p_o-z_{pi})dx_i dy_i$$

where $-rk_1$ is a Hookean spring constant $p_o-z_{pi}$ is the amount of deflection of the base pad $dx_i dy_i$ is the size of the node.

9. The method for pseudo-physically modeling as defined in claim 8 wherein:

the force $F_{2ij}$ from a top pad node is computed using the formula:

$$F_{2ij}=rk_2\ (z_{pj}-z_{pi})l_{ij}h$$

where $rk_2$ is a Hookean spring constant $(z_{pj}-z_{pi})$ is the amount of deflection of the top pad $l_{ti}h$ is the size of the node.

10. The method for pseudo-physically modeling as defined in claim 9 wherein:

the nodal contact force is computed using the formula:

$$f_i = F_{1i} + \sum_{j=1}^{m_1} F_{2[i][m_i(j)]}.$$

11. A method for simulating the performance of a system for chemical mechanical polishing of the surface of a workpiece by a moving pad, said method comprising the steps of:

a) modeling the surface of the workpiece by a collection of nodes located in a plane w, each of said wafer nodes having a location defined by the Cartesian coordinates $x_{wi}$, $y_{wi}$, $z_{wi}$;

b) modeling the surface of the moving pad by a collection of nodes located in a plane P parallel to said plane w, each of said pad nodes having a location defined by the Cartesian coordinates $x_{wi}$, $y_{wi}$, $z_{pi}$;

c) establishing a first linear spring force at each of said pad nodes, said first linear spring force being expressed as a function of the deflection of the pad;

d) establishing a second linear spring force on each of said pad nodes as a function of the connection distance of each pad node to an adjacent pad node;

e) summing said first and second linear spring forces to determine the total force on each pad node;

f) determining the rate of change of a wafer node coordinate $z_{wi}$ during small time segments as a function of the force applied by each pad node on a corresponding workpiece node;

g) determining the deformation of each of said pad nodes during said small time segment, by the change in location of said pad node Cartesian coordinate $z_{pi}$ caused by the total force on each of said pad nodes on the surface of the workpiece;

h) determining the erosion of each node on the workpiece surface in said small time segment by the change in location of each of said workpiece node Cartesian coordinate $z_{wi}$.

12. A method for estimating the feature scale planarity that would result from a chemical mechanical polishing (CMP) process that uses a CMP system having a carrier element configured to hold a workpiece against a stack of polishing pads including a base pad and a top pad, said method comprising:

a) obtaining an initial feature scale pattern associated with said workpiece;

b) acquiring a deformation model of a polishing element associated with said CMP system;

c) said deformation model including the steps of:

1) equating the base pad of a first abstract mathematical spring;

2) equating the top pad to a second abstract mathematical spring connected in series with said first abstract mathematical spring; and d) performing a modeling routine to thereby obtain a feature scale simulation result for said workpiece, said feature scale simulation result being responsive to said initial feature scale pattern and to said deformation model, and representing an estimate of said feature scale planarity.

13. The method as defined in claim 12, wherein:

said initial feature scale pattern is defined at a plurality of nodes; and said deformation model utilizes said first and second abstract mathematical springs associated with one of said nodes.

14. The method as defined in claim 13, wherein:

said performing step performs said modeling routine to generate a simulated contact profile for said polishing element in relation to a current simulated feature scale pattern, said simulated contact profile being responsive to a current state of said first and second abstract mathematical springs; and said performing step performs said modeling routine to simulate erosion of said workpiece in response to said simulated contact profile to thereby obtain said feature scale simulation result.

15. The method as defined in claim 13, wherein:

said performing step performs said modeling routine to determine a localized force profile associated with said polishing element in relation to a current simulated feature scale pattern; and said performing step performs said modeling routine to stimulate erosion of said workpiece in response to said localized force profile to thereby obtain said feature scale simulation result.

16. A method as defined in claim 13, wherein said first and second abstract mathematical springs are associated with adjacent nodes.

17. The method as defined in claim 12 further comprising the step of:

obtaining a plurality of CMP process parameters associated with said CMP procedure, wherein said feature scale simulation result is further responsive to said CMP process parameters.

18. The method as defined in claim 12 wherein said performing step comprises the step of estimating erosion of said workpiece in response to a simulated local force associated with said deformation model.

19. A computer system for estimating the wafer scale uniformity and feature scale planarity that would result from a chemical mechanical polishing (CMP) process performed on a workpiece by a CMP system having a polishing pad stack with a base pad and a top pad, said system comprising:

a processor operable to receive an initial feature scale pattern associated with the workpiece;

wherein the processor is further operable to perform a modeling routine by equating the base pad to a first abstract mathematical spring, and by equating the top pad to a second abstract mathematical spring connected in series with said first abstract mathematical spring and by simulating the operation of the CMP system on the workpiece, based on the initial feature scale patter; thereby providing a wafer scale simulation result representing said wafer scale uniformity and a feature scale simulation result representing said feature scale planarity; and wherein the processor is further operable to compare at least one of said wafer scale simulation result and said feature scale simulation result to an empirical CMP result associated with said CMP process to thereby obtain a simulation error.

20. A computer system for estimating the wafer scale uniformity and feature scale planarity that would result from a chemical mechanical polishing (CMP) process performed on a workpiece by a CMP system having a polishing pad stack with a base pad and a top pad, said system comprising:

a processor operable to receive an initial film thickness profile associated with the workpiece;

wherein the processor is further operable to perform a modeling routine by equating the base pad to a first abstract mathematical spring and equating the top pad to a second abstract mathematical spring connected in series with said first abstract mathematical spring and by simulating the operation of the CMP system on the workpiece, based on the initial film thickness profile; thereby providing a wafer scale simulation result representing said wafer scale uniformity and a feature scale simulation result representing said feature scale planarity; and wherein the processor is further operable to compare at least one of said wafer scale simulation result and said feature scale simulation result to an empirical CMP result associated with said CMP process to thereby obtain a simulation error.

21. A computer-implemented method for estimating the wafer scale uniformity and feature scale planarity that would result from a chemical mechanical polishing (CMP) process performed on a workpiece by a CMP system having a base pad and a top pad, said method comprising the steps of:

receiving an initial feature scale pattern and an initial film thickness profile associated with the workpiece;

performing a modeling routine by equating the base pad to a first abstract mathematical spring and equating the top pad to a second abstract mathematical spring connected in series with said first abstract spring, and by simulating the operation of the CMP system on the workpiece, based on the initial feature scale pattern and the initial film thickness profile, thereby providing a wafer scale simulation result representing said wafer scale uniformity and a feature scale simulation result representing said feature scale planarity.

22. The method as defined in claim 21, wherein:

said wafer scale simulation result comprises a film thickness profile; and said feature scale simulation result comprises a feature pattern profile.

23. The method as defined in claim 22, wherein:

said film thickness profile includes global wafer uniformity information; and said feature pattern profile includes local surface planarization information.

24. The method as defined in claim 21, further including the steps of:

a) obtaining, prior to said performing step, an indicator of the relative importance of global wafer uniformity versus local die planarization for said workpiece; and b) optimizing said CMP process parameters in response to said indicator to thereby produce a CMP data for use during an optimized CMP procedure.

25. The method as defined in claim 21 further including the steps of:

a) initializing a modeling parameter associated with said modeling routine;

b) conducting said CMP procedure to obtain an empirical CMP result;

c) comparing at least one of said wafer scale simulation result and said feature scale simulation result to said empirical CMP result; and d) adjusting said modeling parameter in response to said comparing step.

26. The method as defined in claim 25 wherein said empirical CMP result includes a wafer scale empirical CMP result, said modeling method further including the steps of:

a) comparing said wafer scale simulation result to said wafer scale empirical CMP result; and b) optimizing said modeling parameter such that an error between said feature scale simulation result and said feature scale empirical CMP result is substantially minimized.

27. The method as defined in claim 25 wherein said obtaining, performing, producing, initializing, conducting, comparing, and adjusting steps are performed for an existing CMP system, and wherein said method further includes the steps of:

a) varying at least one of said CMP process parameters to thereby define an updated CMP process parameter set; and b) thereafter repeating said performing step to thereby obtain a second wafer scale simulation result and a second feature simulation result for a theoretical CMP system, each of said second wafer scale simulation result and said second feature scale simulation result being responsive to said updated CMP process parameter set.

28. The method as defined in claim 21, wherein said method further includes the step of obtaining an initial feature scale pattern associated with said workpiece and said performing step is responsive to said initial feature scale pattern.

29. The method as defined in claim 28, further including the steps of:

a) initializing a modeling parameter associated with said modeling routine; and b) optimizing said modeling parameter in response to said initial feature scale pattern.

30. The method as defined in claim 21, wherein said method further includes the step of obtaining an initial film thickness profile associated with said workpiece and said performing step is responsive to said initial film thickness profile.

31. The method as defined in claim 30, further including the steps of:

a) initializing a modeling parameter associated with said modeling routine; and b) optimizing said modeling parameter in response to said initial film thickness profile.

* * * * *